US009105246B2

(12) United States Patent
Tsuchihashi

(10) Patent No.: US 9,105,246 B2
(45) Date of Patent: Aug. 11, 2015

(54) COMPUTER DISPLAY DRIVING SYSTEM

(75) Inventor: Moriyuki Tsuchihashi, Kanagawa-ken (JP)

(73) Assignee: HUAN FUND PTE. L.L.C., Wilmington, DE (US)

( * ) Notice: Subject to any disclaimer, the term of this patent is extended or adjusted under 35 U.S.C. 154(b) by 2178 days.

(21) Appl. No.: 12/050,275

(22) Filed: Mar. 18, 2008

(65) Prior Publication Data

US 2009/0002299 A1 Jan. 1, 2009

Related U.S. Application Data

(62) Division of application No. 10/982,092, filed on Nov. 5, 2004, now Pat. No. 8,803,779.

(30) Foreign Application Priority Data

Nov. 6, 2003 (JP) ..... 2003-376683
Jul. 9, 2004 (JP) ..... 2004-203116

(51) Int. Cl.
*G09G 5/02* (2006.01)
*G09G 3/36* (2006.01)
*G09G 3/20* (2006.01)

(52) U.S. Cl.
CPC ..... *G09G 3/3614* (2013.01); *G09G 3/2018* (2013.01); *G09G 3/2051* (2013.01); *G09G 2320/0233* (2013.01)

(58) Field of Classification Search
CPC ..... G09G 3/2051
USPC ..... 345/694
See application file for complete search history.

(56) References Cited

U.S. PATENT DOCUMENTS

| | | | | |
|---|---|---|---|---|
| 5,712,651 | A | 1/1998 | Tomiyasu | |
| 5,872,554 | A | 2/1999 | Chang et al. | |
| 5,892,496 | A * | 4/1999 | Wakeland | 345/694 |
| 6,072,451 | A * | 6/2000 | Mano et al. | 345/96 |
| 6,084,561 | A | 7/2000 | Kudo et al. | |
| 6,295,041 | B1 | 9/2001 | Leung et al. | |
| 6,359,607 | B1 | 3/2002 | Yanagi et al. | |
| 6,542,141 | B1 | 4/2003 | Mano et al. | |
| 6,606,099 | B2 | 8/2003 | Yamada | |
| 6,801,220 | B2 | 10/2004 | Greier et al. | |
| 6,897,884 | B2 | 5/2005 | Tsuge et al. | |
| 7,038,702 | B2 | 5/2006 | Kudo et al. | |
| 7,176,867 | B2 | 2/2007 | Lee | |
| 7,382,343 | B2 | 6/2008 | Hiraki et al. | |
| 2001/0028346 | A1 | 10/2001 | Kudo et al. | |

(Continued)

FOREIGN PATENT DOCUMENTS

| | | | |
|---|---|---|---|
| JP | 04-356095 | 12/1992 | G09G 3/36 |
| JP | 2003-66915 | 3/2003 | G09G 3/36 |
| JP | 2003-084725 | 3/2003 | G09G 3/36 |

*Primary Examiner* — Adam J Synder
(74) *Attorney, Agent, or Firm* — Amin, Turocy & Watson, LLP

(57) ABSTRACT

An image display system includes an LCD (liquid crystal display) or other display driven by alternating current and driven in an inverted manner by a predetermined driving method on a pixel basis, and an LCD driving device for generating a Frame Rate Control (FRC) pattern which is the same as the pattern utilized by the predetermined driving method. The display is thereby driven so as to allow the display to make an expression in gradations higher (for example, 256 gradations) than gradations (for example, 64 gradations) natively supported by the display.

20 Claims, 25 Drawing Sheets

(56) References Cited

U.S. PATENT DOCUMENTS

| | | | | |
|---|---|---|---|---|
| 2002/0149598 | A1 | 10/2002 | Greier et al. | |
| 2002/0154085 | A1 | 10/2002 | Kim | 345/96 |
| 2003/0011582 | A1 | 1/2003 | Morita | |
| 2003/0048238 | A1* | 3/2003 | Tsuge et al. | 345/55 |
| 2003/0193464 | A1* | 10/2003 | Yamano et al. | 345/89 |
| 2004/0032386 | A1 | 2/2004 | Pai | |
| 2004/0070581 | A1 | 4/2004 | Hiraki et al. | |

* cited by examiner (a) FRAME N

| | | | | | | | |
|---|---|---|---|---|---|---|---|
| 63 | 62 | 63 | 62 | 63 | 62 | 63 | 62 |
| 62 | 63 | 62 | 63 | 62 | 63 | 62 | 63 |
| 63 | 62 | 63 | 62 | 63 | 62 | 63 | 62 |
| 62 | 63 | 62 | 63 | 62 | 63 | 62 | 63 |
| 63 | 62 | 63 | 62 | 63 | 62 | 63 | 62 |
| 62 | 63 | 62 | 63 | 62 | 63 | 62 | 63 |
| 63 | 62 | 63 | 62 | 63 | 62 | 63 | 62 |
| 62 | 63 | 62 | 63 | 62 | 63 | 62 | 63 |

FRC (DISPLAYING 62.5TH GRADATION)

*

| | | | | | | | |
|---|---|---|---|---|---|---|---|
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |

2H1V INVERSION LCD DRIVE

=

| | | | | | | | |
|---|---|---|---|---|---|---|---|
| +63 | −62 | +63 | −62 | +63 | −62 | +63 | −62 |
| −62 | +63 | −62 | +63 | −62 | +63 | −62 | +63 |
| −63 | +62 | −63 | +62 | −63 | +62 | −63 | +62 |
| +62 | −63 | +62 | −63 | +62 | −63 | +62 | −63 |
| +63 | −62 | +63 | −62 | +63 | −62 | +63 | −62 |
| −62 | +63 | −62 | +63 | −62 | +63 | −62 | +63 |
| −63 | +62 | −63 | +62 | −63 | +62 | −63 | +62 |
| +62 | −63 | +62 | −63 | +62 | −63 | +62 | −63 |

DATA ON LCD (b) FRAME N+1

| | | | | | | | |
|---|---|---|---|---|---|---|---|
| 62 | 63 | 62 | 63 | 62 | 63 | 62 | 63 |
| 63 | 62 | 63 | 62 | 63 | 62 | 63 | 62 |
| 62 | 63 | 62 | 63 | 62 | 63 | 62 | 63 |
| 63 | 62 | 63 | 62 | 63 | 62 | 63 | 62 |
| 62 | 63 | 62 | 63 | 62 | 63 | 62 | 63 |
| 63 | 62 | 63 | 62 | 63 | 62 | 63 | 62 |
| 62 | 63 | 62 | 63 | 62 | 63 | 62 | 63 |
| 63 | 62 | 63 | 62 | 63 | 62 | 63 | 62 |

FRC (DISPLAYING 62.5TH GRADATION)

*

| | | | | | | | |
|---|---|---|---|---|---|---|---|
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |

2H1V INVERSION LCD DRIVE

=

| | | | | | | | |
|---|---|---|---|---|---|---|---|
| −62 | +63 | −62 | +63 | −62 | +63 | −62 | +63 |
| +63 | −62 | +63 | −62 | +63 | −62 | +63 | −62 |
| +62 | −63 | +62 | −63 | +62 | −63 | +62 | −63 |
| −63 | +62 | −63 | +62 | −63 | +62 | −63 | +62 |
| −62 | +63 | −62 | +63 | −62 | +63 | −62 | +63 |
| +63 | −62 | +63 | −62 | +63 | −62 | +63 | −62 |
| +62 | −63 | +62 | −63 | +62 | −63 | +62 | −63 |
| −63 | +62 | −63 | +62 | −63 | +62 | −63 | +62 |

DATA ON LCD

FIG. 2

SHIFTING DIRECTION

| | | | | | | | | |
|---|---|---|---|---|---|---|---|---|
| A | B | C | D | E | F | G | H | → |
| B | A | H | G | F | E | D | C | ← |
| G | H | A | B | C | D | E | F | → |
| D | C | B | A | H | G | F | E | ← |
| E | F | G | H | A | B | C | D | → |
| F | E | D | C | B | A | H | G | ← |
| C | D | E | F | G | H | A | B | → |
| H | G | F | E | D | C | B | A | ← |

(a)

(b)

SHIFTING DIRECTION

| | | | | | | | | |
|---|---|---|---|---|---|---|---|---|
| A | B | C | D | E | F | G | H | → |
| A | B | C | D | E | F | G | H | → |
| A | H | G | F | E | D | C | B | ← |
| A | H | G | F | E | D | C | B | ← |
| A | B | G | D | E | F | G | H | → |
| A | B | C | D | E | F | G | H | → |
| A | H | G | F | E | D | C | B | ← |
| A | H | G | F | E | D | C | B | ← |

COMPUTER DISPLAY DRIVING SYSTEM

CROSS REFERENCE TO RELATED APPLICATIONS

This application is a division of application Ser. No. 10/982,092, filed Nov. 5, 2004, which claims priority of Japanese applications, Serial No. 2004-203116, filed Jul. 9, 2004 and Serial No. 2003-376683, filed Nov. 6, 2003.

FIELD OF THE INVENTION

The present invention relates to a method and apparatus for driving a display of a computer system, such as a liquid crystal display, for example. More specifically, the present invention relates to a method and apparatus for driving a display with an improved appearance without increasing the available color gradations.

BACKGROUND OF THE INVENTION

In recent years, liquid crystal displays (liquid crystal display device, LCD) have been widely used in various kinds of personal computers (PC) such as desktop type PCs as well as notebook PCs. An image to be displayed on such a liquid crystal display is processed by a graphics controller of a host device composed of a PC or the like, and then displayed on the liquid crystal display. In this case, even if an operating system (OS) of the host supports 256 gradations per each color of R (red), G (green) and B (blue), for example, often only 64 gradations (0 to 63—represented by six bits of information per color) are actually supported in the liquid crystal display. Accordingly, in the display, it is necessary that the effective gradations per each color be multiplied by four (quadrupled). In order to accomplish this, known methods of Frame Rate Control (FRC) may be utilized for achieving multi-gradation by controlling a lighting time of each dot (each pixel).

FIGS. 25(*a*) to 25(*e*) are views for explaining conventional FRC for the simple example of multi-gradation between a 63rd gradation and a 62nd gradation. As shown in FIG. 25(*a*), with regard to the 63rd gradation, each dot is constantly displayed in the 63rd gradation. Similarly, also with regard to the 62nd gradation shown in FIG. 25(*e*), each dot is constantly displayed in the 62nd gradation. However, in the case of a 62.5th gradation shown in FIG. 25(*e*), which is an intermediate gradation, the 62.5th gradation is realized by a visual average of a displayed pattern alternating between two frames (a frame N and a frame N+1) in which each dot is displayed in the 63rd and 62nd gradations. Note that, in the liquid crystal display, the two frames constitute one cycle, and in the case of viewing a certain pixel, if a polarity of the pixel is positive (+) in the first frame, the polarity turns negative (−) in the next frame. The pixel is driven by alternating current (for example, of 60 Hz) in a cycle of two frames. There are various methods for inverting the polarities of the liquid crystal pixels adjacent to one another depending on a type of the liquid crystal display. FIG. 25(*c*) shows a check pattern (a pattern where squares are arrayed in a staggered manner, as in a chessboard).

Moreover, in a 62.75th gradation shown in FIG. 25(*b*), the 63rd gradation and the 62nd gradation in each dot is mixed in a ratio of 2:1, and three different frames are prepared. Then, the 62.75th gradation is realized by a visual average created by alternatively displaying each of the three frames (the frame N, the frame N+1 and a frame N+2). Furthermore, in a 62.25th gradation shown in FIG. 25(*d*), the 63rd gradation and the 62nd gradation in each dot is mixed in a ratio of 1:2, and three different frames are prepared. Then, the 62.25th gradation is realized by a visual average created by alternatively displaying each of the three frames. Note that the ratio used is not a ratio of 1:3 or 3:1 but a ratio of 1:2 or 2:1 is employed—this is because a known visual element for a slew rate of the liquid crystal display, and the like, is considered.

There exists a well-known technology of changing a frame frequency depending on whether the number of colors in data to be displayed is a predetermined number of colors or less or exceeds the predetermined number of colors (for example, see Japanese Unexamined, Published Patent Publication No. 2002-149118, pp. 5-6, FIG. 1) in order to prevent flickering on a color liquid crystal screen mounted on a portable information terminal device.

Herein, there are several LCD driving methods well-known to those skilled in the relevant arts. In terms of inversion drive at a vertical line (V line) and a horizontal line (H line), there are 1H1V inversion LCD drives, 2H1V inversion drives, 1H2V inversion drives, 2H2V inversion drives, and the like. The 1H1V inversion LCD drive inverts the lines to form a normal check pattern. The 2H1V inversion drive inverts a pattern, which is inverted by every two H lines, for each V line. The 1H2V inversion drive inverts a pattern, which is inverted by each H line, by every two V lines. The 2H2V inversion drive inverts a pattern, which is inverted by every two H lines, by every two V lines.

Meanwhile, there are several known FRC methods for multi-gradation. Since the foregoing LCD driving methods are not considered in the conventional FRC methods which have been widely used, a fixed pattern display error occurs when an x.5-th gradation, for example, the 62.5th gradation is displayed (x is an integer more than or equal to 0 determined by gradations of a display, e.g., 0 to 62). In other words, for example, in the case where a 64 gradation LCD employs an FRC for 256 gradation display, a fixed pattern display error occurs when an image is displayed using conventional FRC methods—the type of error depending on a combination of the LCD driving method and the FRC pattern utilized.

When a mixture ratio of an A-th gradation to a B-th gradation, such as of the 63rd gradation to the 62nd gradation, is not 1:1, for example, when the mixture ratio is 1:2 or 2:1, there are three fixed patterns as shown in FIGS. 25(*b*) and 25(*c*). The alignment of these three fixed patterns is shifted in one direction. As a result, when a conventional FRC method is employed, a dynamic display error (wave stripe) occurs, in which an oblique stripe pattern is seen as flowing across the display.

In the Published Japanese Patent Application listed above, flickering is prevented by changing a frame frequency. However, this technique can effectively be applied only when LCD resolution is low as in mobile phones (e.g., 240×320 dots) and there is the possibility of increasing the screen frequency. For example, the screen resolution of a PC display of the Extended Graphics Array (XGA) type may be 1024×768 dots This resolution is approximately 10 times larger than that of the mobile phone. Moreover, a pixel transfer rate is approximately 100 MHz by two pixel simultaneous transmission in PCs, and it is almost impossible to maintain a screen frequency at 60 Hz, where a flicker is invisible. Accordingly, it is difficult to increase the screen frequency. In addition, a screen frequency of a high resolution LCD is unlikely to be increased since the increase will lead to increases in both power consumption and manufacturing costs. Therefore, it is impossible to apply the technique disclosed in the Published Japanese Patent Application discussed above to an LCD for a PC or the like.

SUMMARY OF THE INVENTION

The present invention has been made to solve the technical problems described above. An object of the present invention is to eliminate fixed pattern display, which is visually recognized, in a display employing a drive inversion method, such as a liquid crystal display (LCD).

Another object of the present invention is to eliminate dynamic pattern display, in which a stripe pattern is seen as flowing in a certain direction.

Still another object of the present invention is to enable a display providing 64 color gradations to provide an image quality comparable to a display providing 256 color gradations.

Yet another object of the present invention is to provide for inexpensive manufacture of such a display product even though the pattern display problems have been eliminated to provide high image quality.

In order to meet the aforementioned objects, the present invention is a display driving device for receiving data expressed by first gradations from a host and performing first gradation display on a display supporting second gradations lower than the first gradations, the display driving device comprising: inversion driving method recognizing means for recognizing an inversion driving method of the display; and outputting means for outputting pixel data to the display by using the same FRC pattern as a pattern of the inversion driving method recognized by the inversion driving method recognizing means. Here, the display driving device is characterized in that the inversion driving method recognized by the inversion driving method recognizing means is any of a 2H1V inversion driving method of inverting, by each V line, a pattern inverted by every 2H lines, a 1H2V inversion driving method of inverting, by every 2V lines, a pattern inverted by each H line, and a 2H2V inversion driving method of inverting, by every 2V lines, a pattern inverted by every 2H lines, and the outputting means outputs data of each pixel by using an FRC pattern of any of 2H1V, 1H2V and 2H2V, the FRC pattern being the same as the pattern of the inversion driving method. Moreover, the display driving device can be characterized in that the inversion driving method recognizing means recognizes the inversion driving method by examining the contents of a register provided in the display.

Meanwhile, an image display system such as, for example, a notebook PC, to which the present invention is applied, comprises: a display driven by alternating current and driven in an inverted manner by a predetermined driving method on a pixel basis; and a driving device for generating the same FRC pattern as a pattern utilized by the predetermined driving method and for driving the display to allow the display to make an expression in gradations higher than gradations owned by the display. However, the case where both of the pattern utilized by the predetermined driving method and the FRC pattern are of 1H1V is excluded. This 1H1V is one inverting, by each V line, a pattern inverted by each H line, such as in a staggered array (pattern of a chessboard). Here, the image display system can be characterized in that the FRC pattern generated by the driving device is an x.5-th gradation pattern (x is an integer more than or equal to 0 determined by the gradations owned by the display).

Viewed in another way, an image display system to which the present invention is applied comprises: a display driven by alternating current and driven in an inverted manner by a predetermined inversion driving method on a pixel basis; and a driving device for driving the display by using an FRC pattern to allow the display to make an expression in gradations higher than gradations provided by the display. This image display system can be characterized in that the driving device drives the display to equalize, in each pixel, a central potential of drive by a combination of the inversion driving method and the FRC pattern. However, as in the aforementioned image display system, the case where both of the pattern of the inversion driving method and the FRC pattern are of 1H1V is excluded.

Furthermore, the present invention is a display driving device for performing first gradation display on a display supporting second gradations lower than first gradations, the display driving device comprising: pattern generating means for generating an FRC pattern by allocating, for each pixel, an A-th gradation and a B-th gradation (A and B are integers more than or equal to 0), which are sequential and included in the second gradations; and shifting means for shifting adjacent lines in different directions by every one line or by plural lines, the lines being lines of the FRC pattern generated by the pattern generating means. Here, if the display driving device is characterized in that this shifting means alternately shifts odd lines and even lines on condition that a mixture ratio of the A-th gradation and the B-th gradation is other than 1:1, then this is preferable in that the occurrence of the dynamic pattern can be restricted. Moreover, the display driving device can be characterized in that the plural lines which are a unit shifted by the shifting means are a combination of lines canceling polarities on condition that polarity inversion drive is performed. The combination of the lines canceling the polarities may be horizontal two lines (2H lines) and horizontal four lines (4H lines), for example, in a case where vertical polarities are neutralized. Furthermore, the lines shifted by the shifting means may be any of horizontal lines and vertical lines.

Moreover, a display driving device to which the present invention is applied comprises: a tile table provided to correspond to a horizontal address and a vertical address of an FRC (Frame Rate Control) pattern formed by allocating, for each pixel, an A-th gradation and a B-th gradation (A and B are integers more than or equal to 0), which are sequential and included in the second gradations; and a ring counter for shifting lines of the tile table in different directions by every one line or by plural lines. Here, the display driving device can be characterized in that this ring counter shifts odd lines and even lines by one according to an end of one screen. Moreover, the display driving device can be characterized in that the ring counter shifts the lines for each plural line by one in response to an end of one screen. Furthermore, when implemented as a method, the present invention is a display method for receiving data expressed by first gradations from a host and performing first gradation display on a display supporting second gradations lower than the first gradations, the method comprising the steps of: recognizing an inversion driving method of the display; and outputting pixel data to the display by using the same FRC pattern as a pattern of the inversion driving method recognized. Here, the display method can be characterized in that the recognizing step recognizes the inversion driving method by examining the contents of a register provided in the display.

Moreover, in another aspect, the present invention is a display method for performing first gradation display on a display supporting second gradations lower than first gradations, the method comprising the steps of: performing inversion drive by a predetermined pattern to a frame N and a frame N+1 in x.5-th gradation display (x is an integer more than or equal to 0 determined by the second gradations); and outputting pixel data to the display by using an FRC (Frame Rate Control) pattern capable of equalizing, in each pixel, a central potential of drive by a combination with the inversion drive.

However, the case where both of the predetermined pattern and the FRC pattern are of 1H1V is excluded. Here, the display method can be characterized in that this FRC pattern is the same as the predetermined pattern driven in an inverted manner.

Meanwhile, a display method to which the present invention is applied comprises the steps of: generating an FRC pattern by allocating, for each pixel, an A-th gradation and a B-th gradation, which are sequential and included in the second gradations (A and B are integers more than or equal to 0); shifting adjacent lines in different directions by every one line or by plural lines, the lines being lines of the FRC pattern generated; and outputting pixel data to the display by using a pattern formed by being shifted. Here, the display method can be characterized in that, in this FRC pattern generated, a mixture ratio of the A-th gradation and the B-th gradation is other than 1:1.

When operating in accordance with the present invention, it is possible to achieve high quality display images by eliminating the fixed pattern display and the dynamic pattern display problems which are typically evident when a high-gradation display image is realized on a display having low-gradation capabilities.

BRIEF DESCRIPTION OF THE DRAWINGS

Embodiments of the present invention will be described in some detail in the following specification and with reference to the following figures in which like elements are referred to using like reference numbers and in which:

FIGS. 2(*a*) and 2(*b*) are diagrams used in explaining a cause of a fixed pattern display error;

DETAILED DESCRIPTION OF EMBODIMENTS OF THE PRESENT INVENTION

Hereinafter, the present invention will be explained by way of description of exemplary embodiments, however, these embodiments should not be read as limiting the invention's scope which shall be delineated solely by the claims appended hereto. In addition, all combinations of characteristics explained in these embodiments are not necessary for each implementation of the invention.

First, prior to detailed description of constituent components, in order to facilitate understanding thereof, some fundamentals of LCD driving methods and a fixed pattern display error in FRC (Frame Rate Control) are explained.

Figure 1:
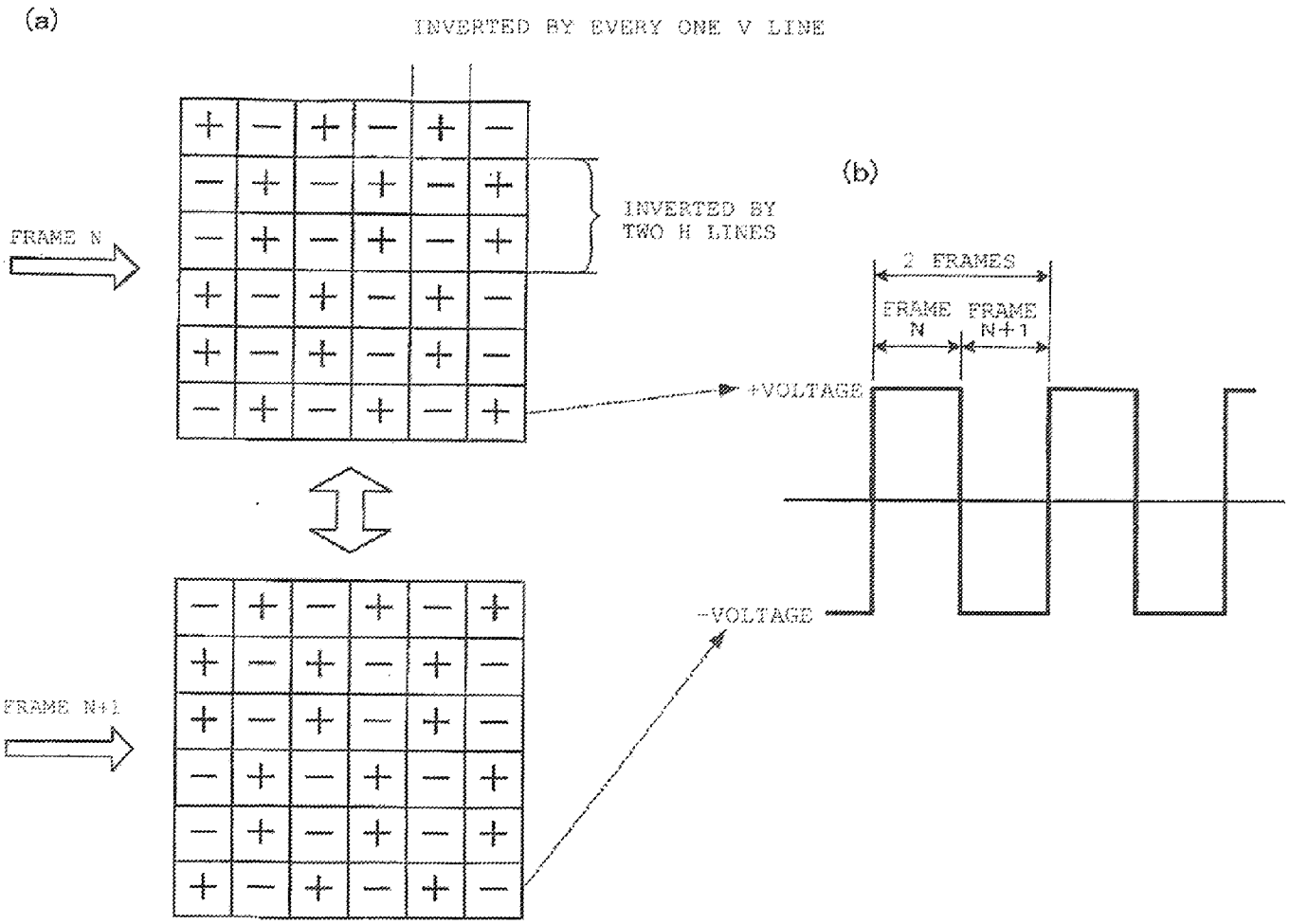
FIGS. 1(*a*) and 1(*b*) are diagrams used in explaining the some fundamentals of inversion driving a display.

FIGS. 1(*a*) and 1(*b*) are views for explaining the fundamentals of an inversion LCD drive. In FIG. 1(*a*), LCD drive viewed on the entire screen is shown with regard to 2H1V inversion LCD drive, in which inversion LCD drive in a frame N and a frame N+1 are expressed. Here, each pixel is driven independently by alternating current. Moreover, FIG. 1(*a*) shows the 2H1V inversion LCD drive, in which the LCD drive combining inversion by every two H lines and inversion by each V line is performed. In FIG. 1(*b*), an LCD drive signal viewed on a pixel basis is shown. The LCD is driven by alternating current signals, in each of which one cycle is composed of two frames, that is, the frame N and the frame N+1. It is desired that the alternating current signal be symmetrical in potential with respect to 0V.

Next, an explanation will be made for the fixed pattern display error occurring when displaying an x.5-th gradation (x is an integer more than or equal to 0 determined by the number of gradations supported by the LCD, for example, 0 to 62), for example, a 62.5th gradation.

FIGS. 2(*a*), 2(*b*) and 3 are views for explaining a cause of the fixed pattern display error. Here, the 62.5th gradation is taken as an example. First, in order to mix the 62nd gradation and the 63rd gradation more finely when displaying the 62.5th gradation in the frame N by the FRC, a check pattern made of both of the gradations is employed as shown in FIG. 2(*a*). When this check pattern is multiplied by such 2H1V inversion LCD drive as shown in FIG. 2(*a*), data on the LCD comes to have a content which is made of each pair of +63 and −62, and each pair of −63 and +62 as shown in a right end diagram of FIG. 2(*a*). Meanwhile, in the frame N+1 shown in FIG. 2(*b*), the 62nd gradation and the 63rd gradation are inverted from those in the FRC shown in FIG. 2(*a*), and polarities of the pixels are reversed in the 2H1V inversion LCD drive. When these pattern and 2H1V inversion LCD drive are multiplied by each other, data on the LCD takes a content of values, which is made of each pair of −62 and +63 and each pair of +62 and −63 as shown in a right end diagram of FIG. 2(*b*).

Figure 3:
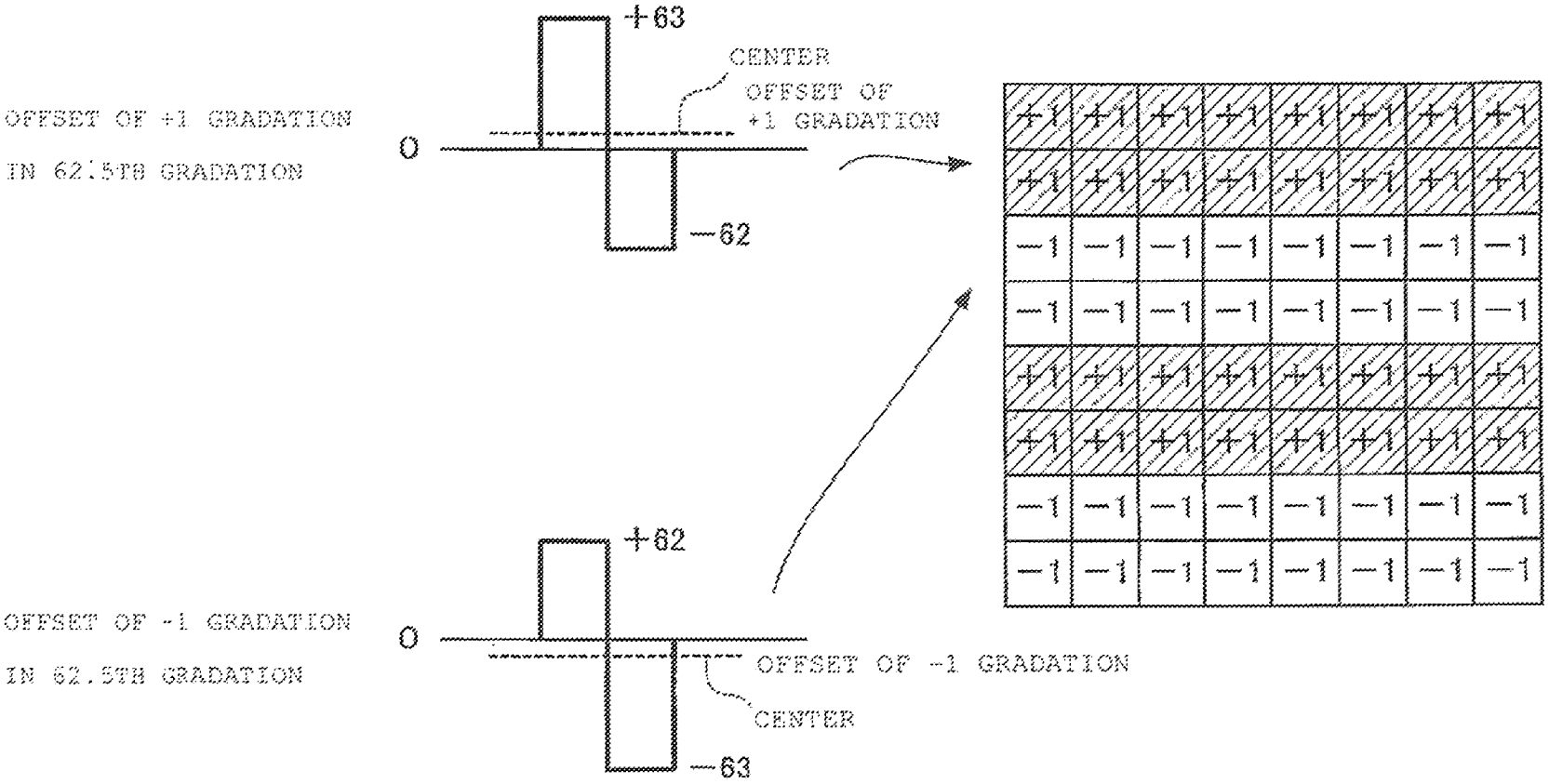
FIG. 3 is a diagram used in further explaining a cause of the fixed pattern display error.

When the 62.5th gradation is shown by the FRC and the 2H1V inversion LCD drive, which are as shown in FIGS. 2(*a*) and 2(*b*), the entire screen turns to the 62.5th gradation, and accordingly, the screen looks even at a glance. However, actually, as shown in FIG. 3, two types of 62.5th gradations, that is, a 62.5th gradation in which a center position is offset by +1 gradation and a 62.5th gradation in which a center position is offset by −1 gradation, become undesirably present. Consequently, in a displayed image, values of +1 and values −1 which are as shown in a right end diagram of FIG. 3 will be repeated every two lines when FIG. 2(*a*) and FIG. 2(*b*) are summed up. Such a gradation shift occurring every two lines results in a subtle color difference, and the image is visually viewed as a 2H stripe.

In recognition of this phenomenon, the inventors focused on the combination of the FRC method and the LCD driving method, and attempted to determine the cause of this shift of the center position. Types of the FRC methods and LCD driving methods which are to be subjected to this combination are shown in FIGS. 4 and 5, and combination results of these are shown in FIG. 6.

Figure 4:
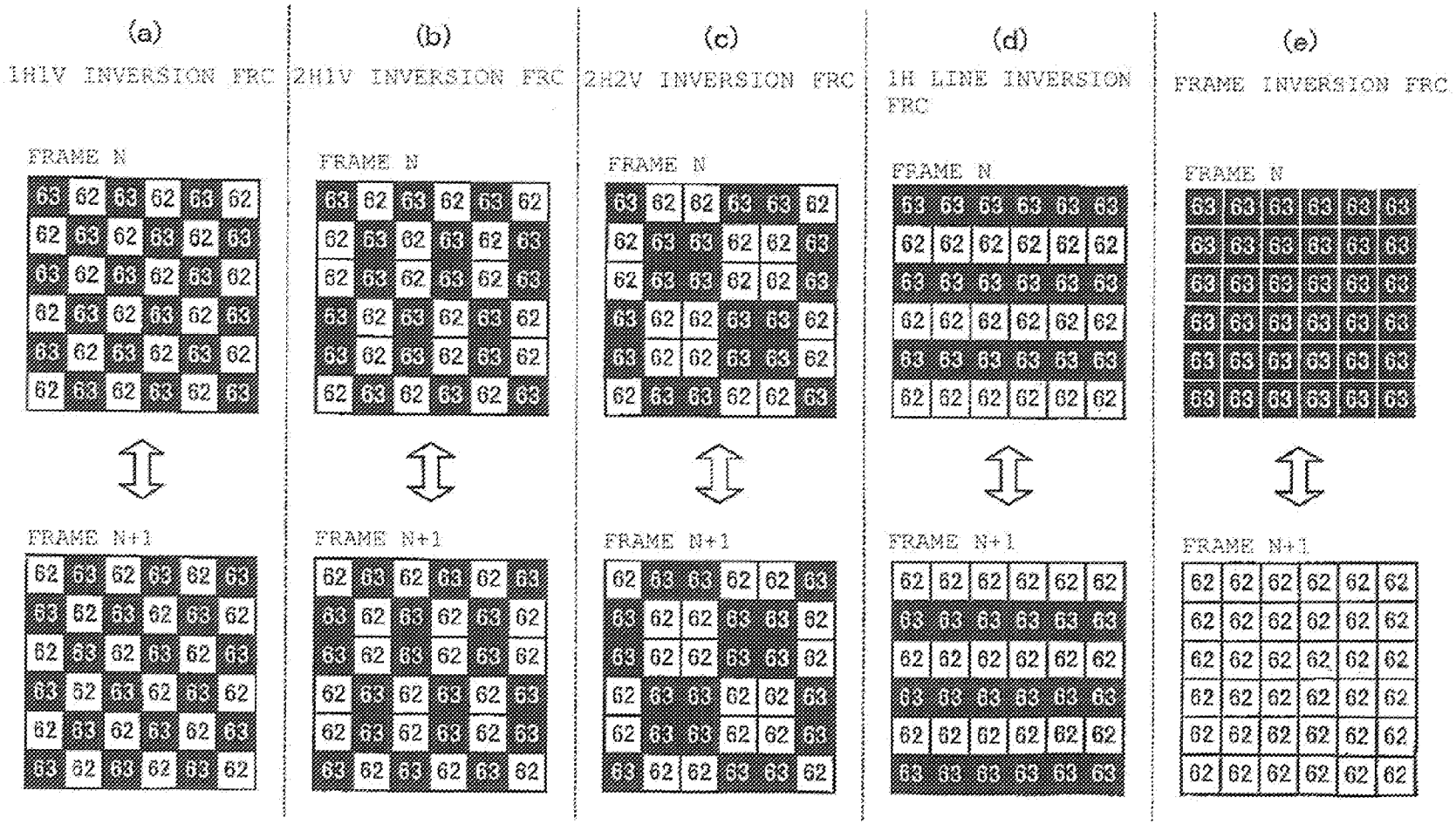
FIGS. 4(*a*) to 4(*e*) are diagrams showing pattern examples of an x.5-th gradation according to methods of FRC.

FIGS. 4(*a*) to 4(*e*) are views showing pattern examples of the x.5-th gradation according to the FRC methods. Here, patterns of the 62.5th gradation obtained by the combination of the 63rd gradation and the 62nd gradation are taken as examples. Pixels in the 63rd gradation are expressed by white-on-black characters, and pixels in the 62nd gradation are expressed by black-on-white characters. In each view, an upper diagram shows the frame N, and a lower diagram shows the frame N+1. These gradation patterns are alternately repeated. FIG. 4(*a*) shows 1H1V inversion FRC, FIG. 4(*b*) shows 2H1V inversion FRC, FIG. 4(*c*) shows 2H2V inversion FRC, FIG. 4(*d*) shows 1H line inversion FRC, and FIG. 4(*e*) shows frame inversion FRC.

Figure 5:
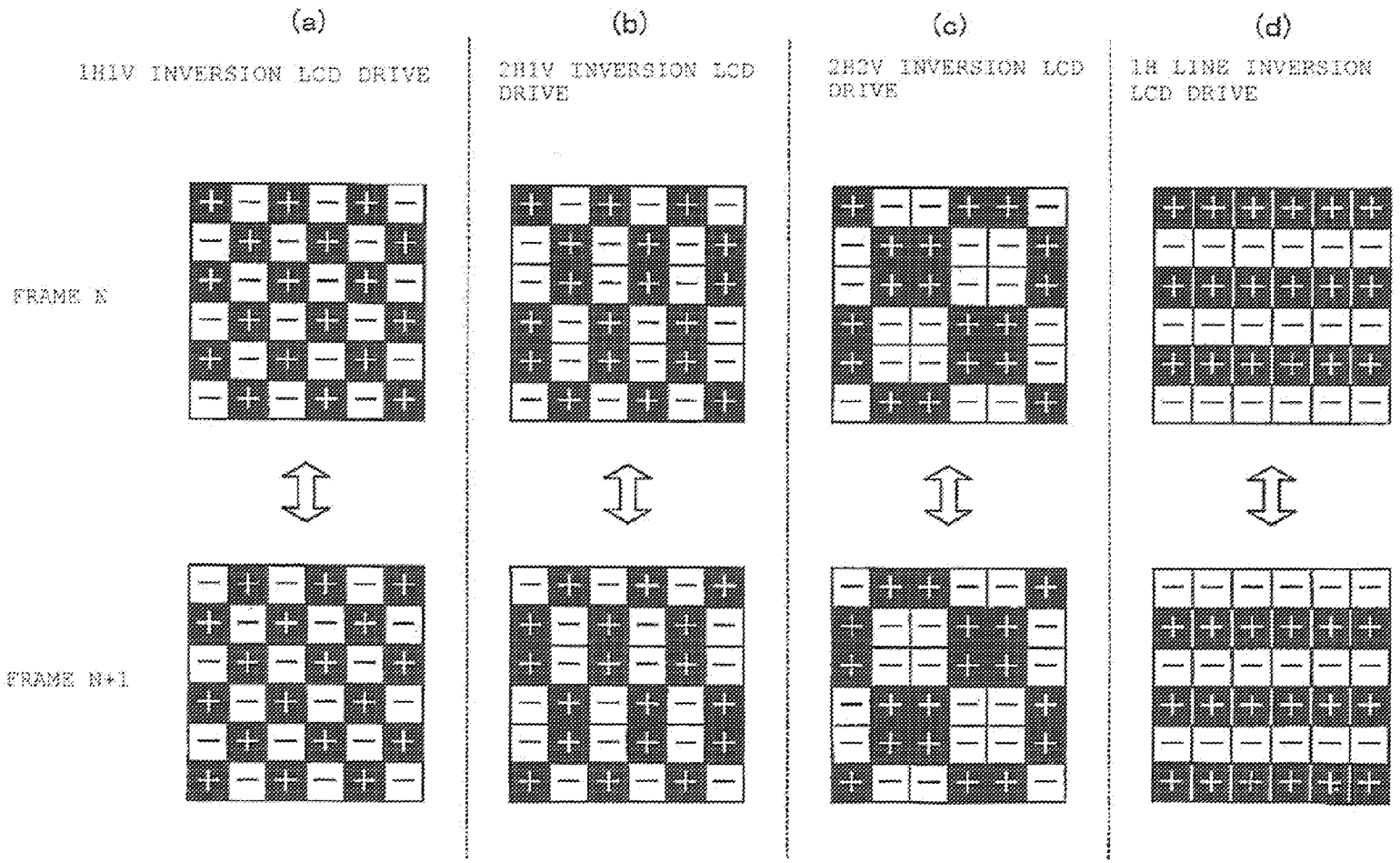
FIGS. 5(*a*) to 5(*d*) are diagrams showing pattern examples of LCD inversion driving methods.

Meanwhile, FIGS. 5(*a*) to 5(*d*) are views showing pattern examples of the LCD driving methods. In each view, an upper diagram shows the frame N, and a lower diagram shows the frame N+1. Gradation patterns of the upper and lower diagrams, which are changed in terms of the polarities of the pixels, are alternately repeated. Pixels at a positive (+) potential are expressed by white-on-black characters, and pixels at a negative (−) potential are expressed by black-on-white characters. FIG. 5(*a*) shows 1H1V inversion LCD drive, FIG. 5(*b*) shows 2H1V inversion LCD drive, FIG. 5(*c*) shows 2H2V inversion LCD drive, and FIG. 5(*d*) shows 1H line inversion LCD drive.

Figure 6:
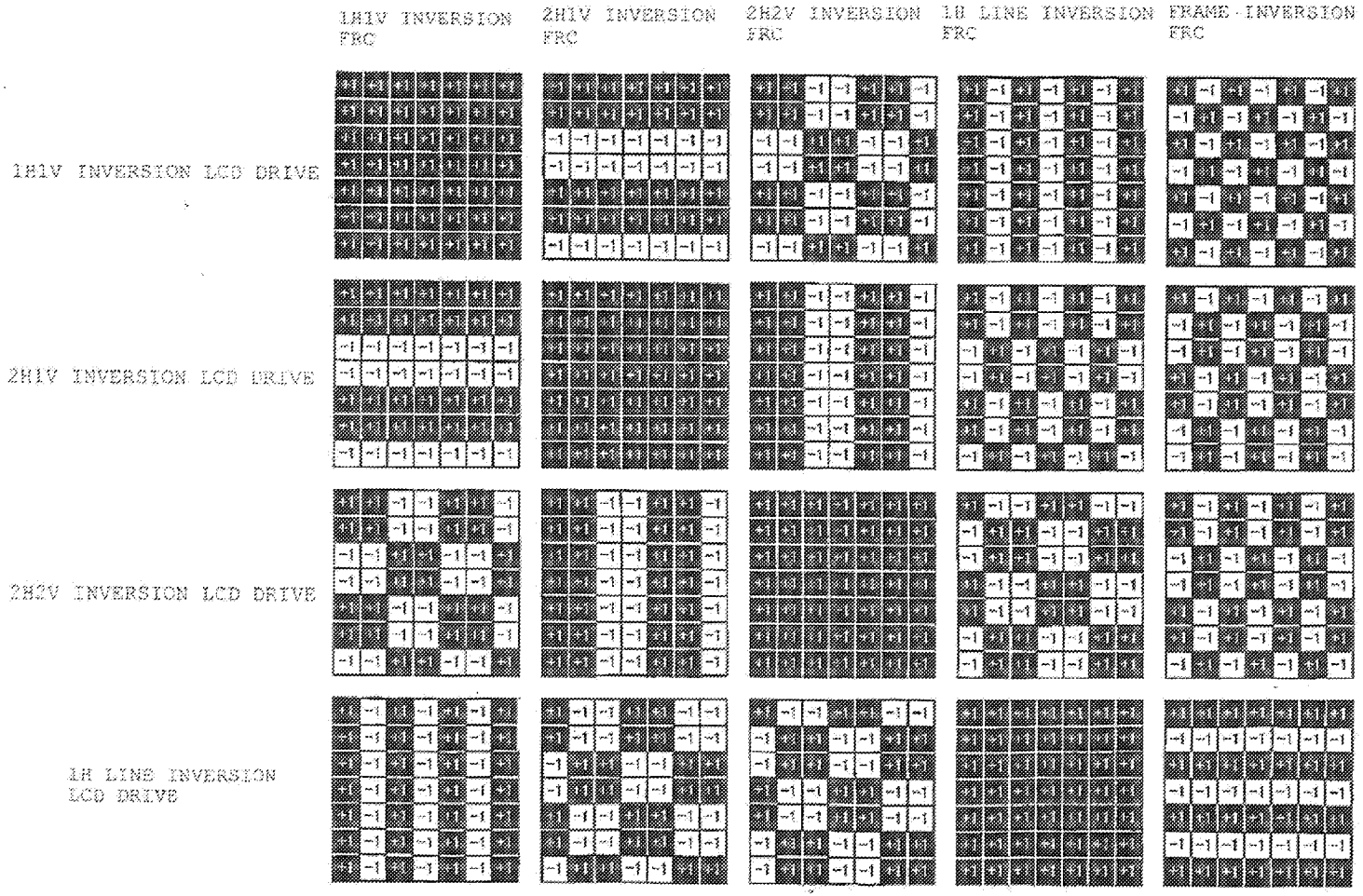
FIG. 6 is a diagram showing simulation results of combinations of the FRC methods shown in FIGS. 4(*a*) to 4(*e*) and the LCD inversion driving methods shown in FIGS. 5(*a*) to 5(*d*)

FIG. 6 is a view showing simulation results of the combinations of the FRC methods shown in FIGS. 4(*a*) to 4(*e*) and the LCD driving methods shown in FIGS. 5(*a*) to 5(*d*). Five types of the inversion FRC methods are arrayed, four types of the LCD driving methods are arrayed, and relationships therebetween are arranged as a matrix. Here, pixels in each of which the center is offset by the +1 gradation are expressed by white-on-black characters, and pixels in each of which the center is offset by the −1 gradation are expressed by black-on-white characters. In simulation results where patterns are expressed by the black and white bases, fixed patterns may visually appear in some cases. When the simulation results of FIG. 6 were observed, it has been newly discovered that two types of the x.5-th gradations in which the centers are offset (shifted) by the +1 gradation and the −1 gradation are undesirably formed in a case where the pattern of the LCD driving method and the pattern of the FRC method are different from each other. Although the presence of these different gradation offsets is at a level without any problem in terms of reliability of the LCD, the resultant image is visually seen as having different gradations, and cannot bear comparison in image quality with the case where the FRC is not implemented.

On the other hand, what has been finally discovered is that, where the pattern of the LCD driving method and the pattern of the FRC method are the same, the different gradations are not present, and image quality at a level favorably comparable with image quality of a 256 gradation LCD can be obtained by a 64 gradation LCD. Note that, while the 1H1V inversion FRC pattern and the 1H1V inversion LCD drive pattern have been conventionally used, the combination of the 1H1V FRC method and the 1H1V LCD driving method has not been considered herein.

Note that, by driving the LCD such that the offsets as shown in FIG. 3 are not present and a central potential of the drive becomes the same in each pixel, it is possible to obtain, using a 64-gradation LCD, an image quality at a level favorably comparable with the image quality of a 256 gradation LCD. As long as the central potential can be made the same in each pixel, it is not always necessary that the pattern of the LCD driving method and the pattern of the FRC method be the same. For example, keeping in mind that a frequency will rise, one set is not composed of two frames but four frames, and the same patterns are output in the positive and negative polarities. Thus, the central potential of the drive can be made the same.

Figure 7:
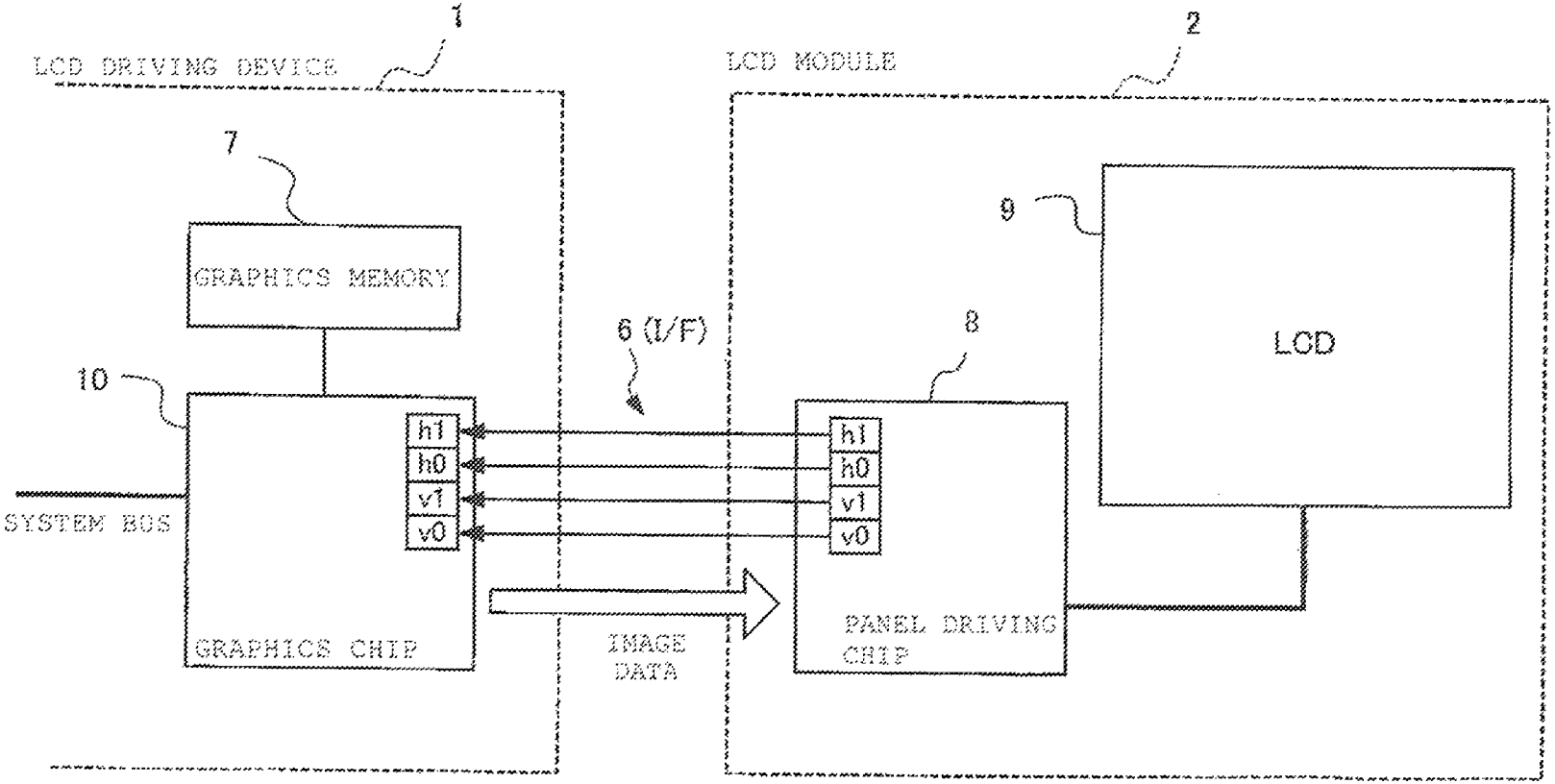
FIG. 7 is a block diagram showing an exemplary configuration of an image display system according to embodiments of the present invention.

FIG. 7 is a block diagram showing an exemplary configuration of an image display system to which this embodiment is applied. This image display system is constructed of a LCD driving device 1 which is connected to a host for driving the display device, and of an LCD module 2 which belongs to a display for actually displaying an image. The LCD module 2 is connected to the LCD driving device 1 through an LCD interface (I/F) 6. In the case of constructing the image display system of a notebook PC, these LCD driving device 1 and LCD module 2 are housed in one cabinet. When the respective functions are dispersed as in a desktop PC, the LCD driving device 1 is configured as a single PC unit, and the LCD module 2 is configured as a single display device. In this embodiment, the LCD module 2 includes a function to display 64 gradations (that is, supports the 64 gradations), and the LCD driving device 1 includes a function to allow the LCD module 2 of the 64 gradations to display pixel data with 256 gradations by means of the FRC.

This LCD driving device 1 includes a graphics chip 10 executing expansion processing of the pixel data, and a graphics memory 7 expanding the image. The graphics chip 10 receives data to be outputted, which is composed of the 256 gradations, through a system bus connected to a host system (not shown) executing an application. Then, the LCD driving device 1 outputs the pixel data, which is expanded by use of the graphics memory 7, to the LCD module 2 through the LCD interface (I/F) 6. Moreover, as a characteristic configuration in this embodiment, this graphics chip 10 executes the aforementioned FRC. Meanwhile, the LCD module 2 includes a panel driving chip 8 performing communication with the graphics chip 10 of the LCD driving device 1, and an LCD (liquid crystal display device) 9 which is driven by the panel driving chip 8 and actually displays the image.

To the LCD module 2, a register indicating driving methods of the LCD 9 is added, and as shown in FIG. 7, this register is composed of, for example, four bits of h1, h0, v1 and v0. The graphics chip 10 reads information which is composed of these four bits and indicates the LCD driving methods, and selects FRC methods matching with these LCD driving methods.

Here, a bit configuration of the register, which indicates the LCD driving methods, will be described as below.

h(1 . . . 0)
00: No H inversion
01: 1H inversion
10: 2H inversion
11: NA
v(1 . . . 0)
00: No V inversion
01: 1V inversion
10: 2V inversion
11: NA Note that, as a connection method using these four bits, besides a direct connection method (Parallel Read), there is a method of performing Serial Read by assigning these bits to EDID (Extended Display Identification Data) already present in the LCD module 2. If an assignment is made to this EDID which is a specification for transmitting information concerning the display from the display to the host, the number of connections in the LCD interface (I/F) is not increased.

Figure 8:
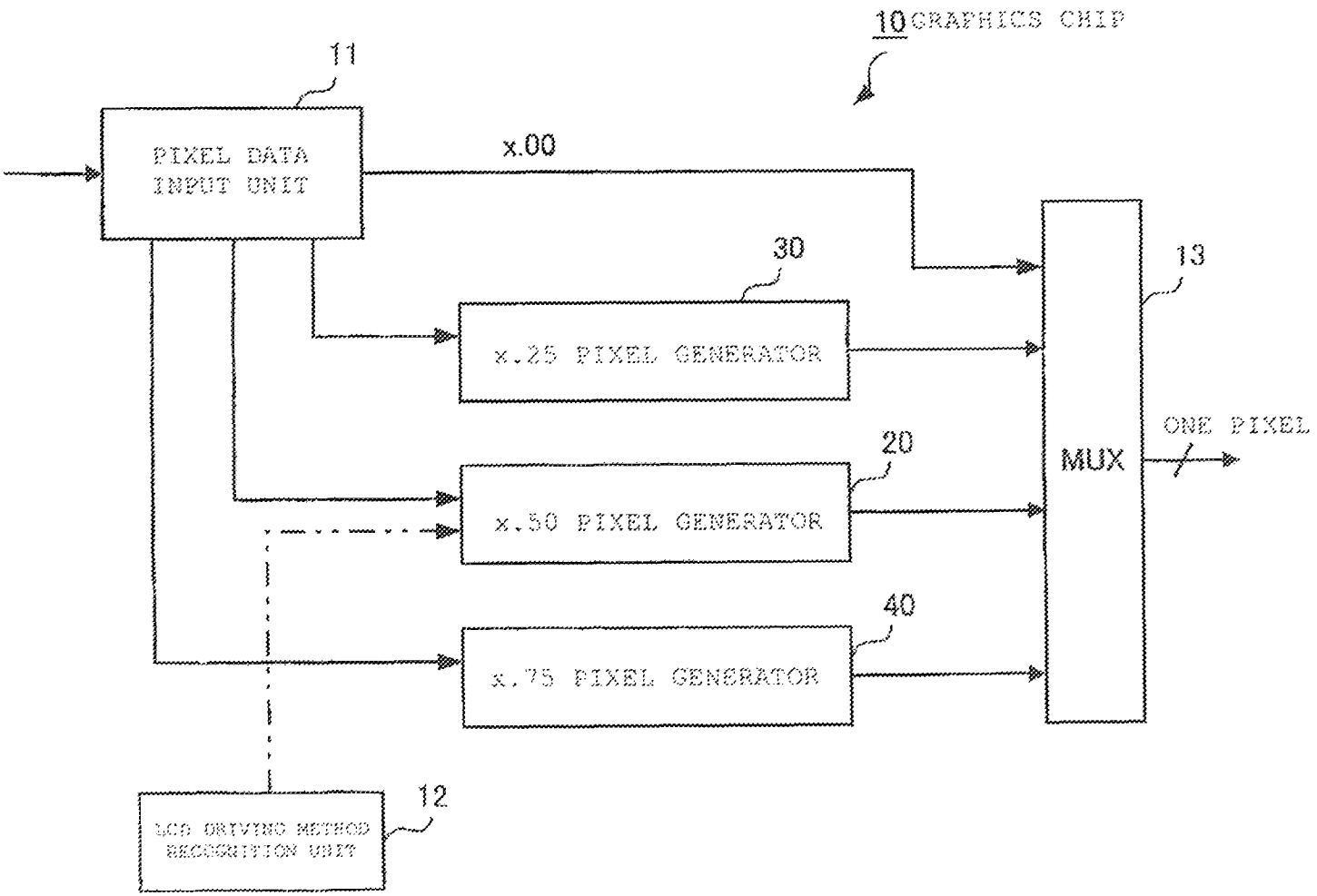
FIG. 8 is a block diagram of a graphics chip useful in accordance with embodiments of the present invention.

FIG. 8 is a block diagram showing an example of the graphics chip 10. The graphics chip 10 to which this embodiment is applied includes a pixel data input unit 11 for receiving the pixel data, and an LCD driving method recognition unit 12 for recognizing the LCD driving method in the LCD module 2. Moreover, the graphics chip 10 includes an x.50 pixel generator 20 for generating a pixel of the x.50-th gradation such as the 62.5th gradation, an x.25 pixel generator 30 for generating a pixel of the x.25-th gradation such as the 62.25th gradation, and an x.75 pixel generator 40 for generating a pixel of the x.75-th gradation such as the 62.75th gradation. Furthermore, the graphics chip 10 includes a multiplexer (MUX) 13 for multiplexing, into one pixel, an x.00 pixel inputted from the pixel data input unit 11 and the pixels generated individually by the respective generators, and outputting the multiplexed pixel. In the pixel data input unit 11, the inputted pixel data of the 256 gradations undergoes conversion matching with the number of gradations supported by the LCD 9, and pixel data composed of 63, 62.75, 62.5, 62.25 . . . , 0.50, 0.25 and 0-th gradations is outputted. From the multiplexer (MUX) 13, pixel data expressed by gradations corresponding to those of the LCD 9 on a pixel basis, for example, the 0 to 63rd gradations, is outputted.

Figure 9:
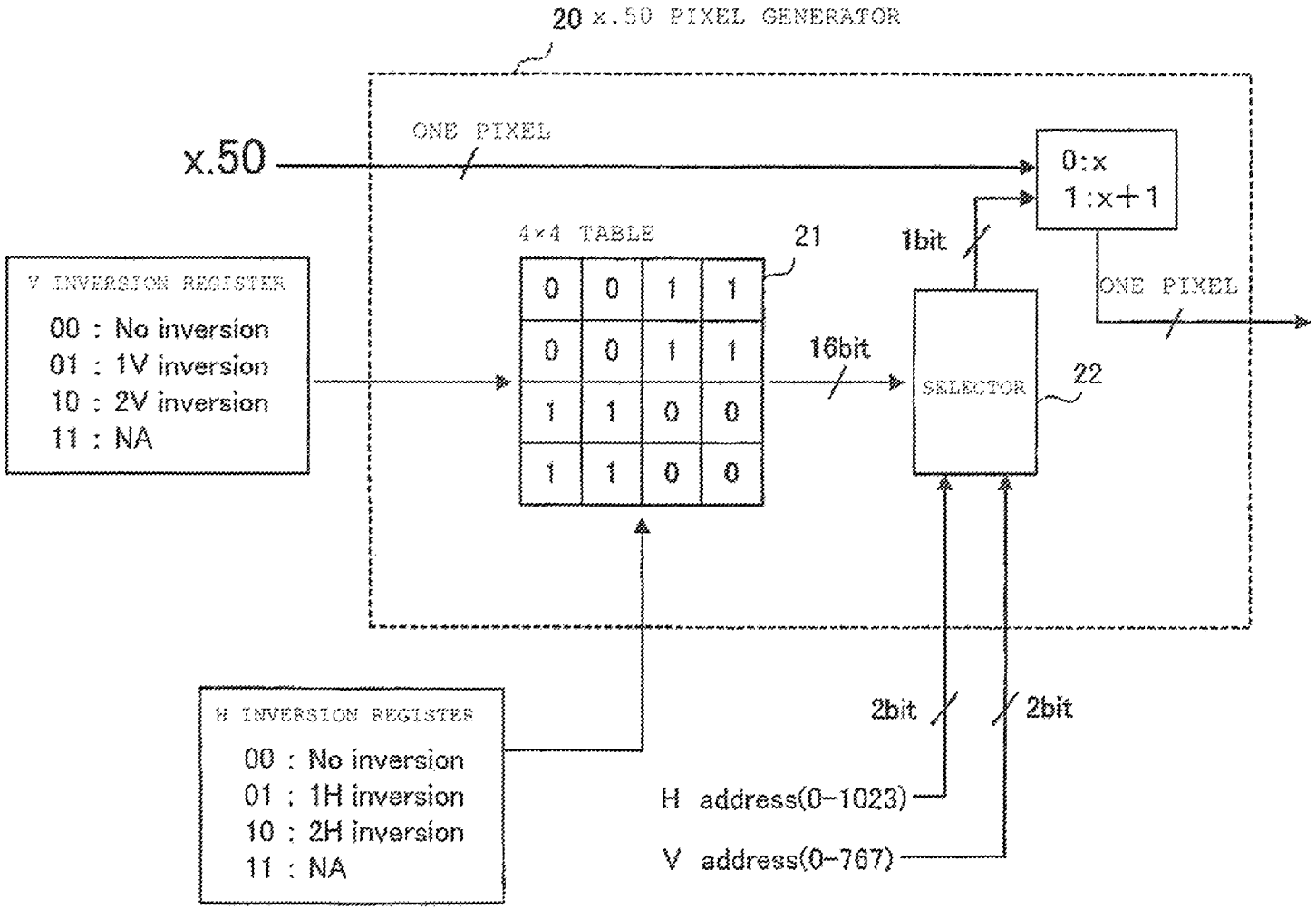
FIG. 9 is a block diagram of an exemplary x.50 pixel generator as a characteristic configuration in Embodiment 1 hereof.

The x.50 pixel generator 20 of FIG. 9 represents an exemplary configuration of embodiment 1 hereof and includes a 4×4 table 21 created correspondingly to the data set in such V-inversion register and H-inversion register described above, and a selector 22 for outputting data 0 or data 1 based on tables corresponding to low-order two bits of an H address and low-order two bits of a V address. In the case of expressing the x.50-th gradation (for example, 62.5th gradation), when 0 is outputted from the selector 22, x (for example, 62) is selected for each pixel. Moreover, when 1 is outputted from the selector 22, x+1 (for example, 63) is selected for each pixel.

Figure 10:
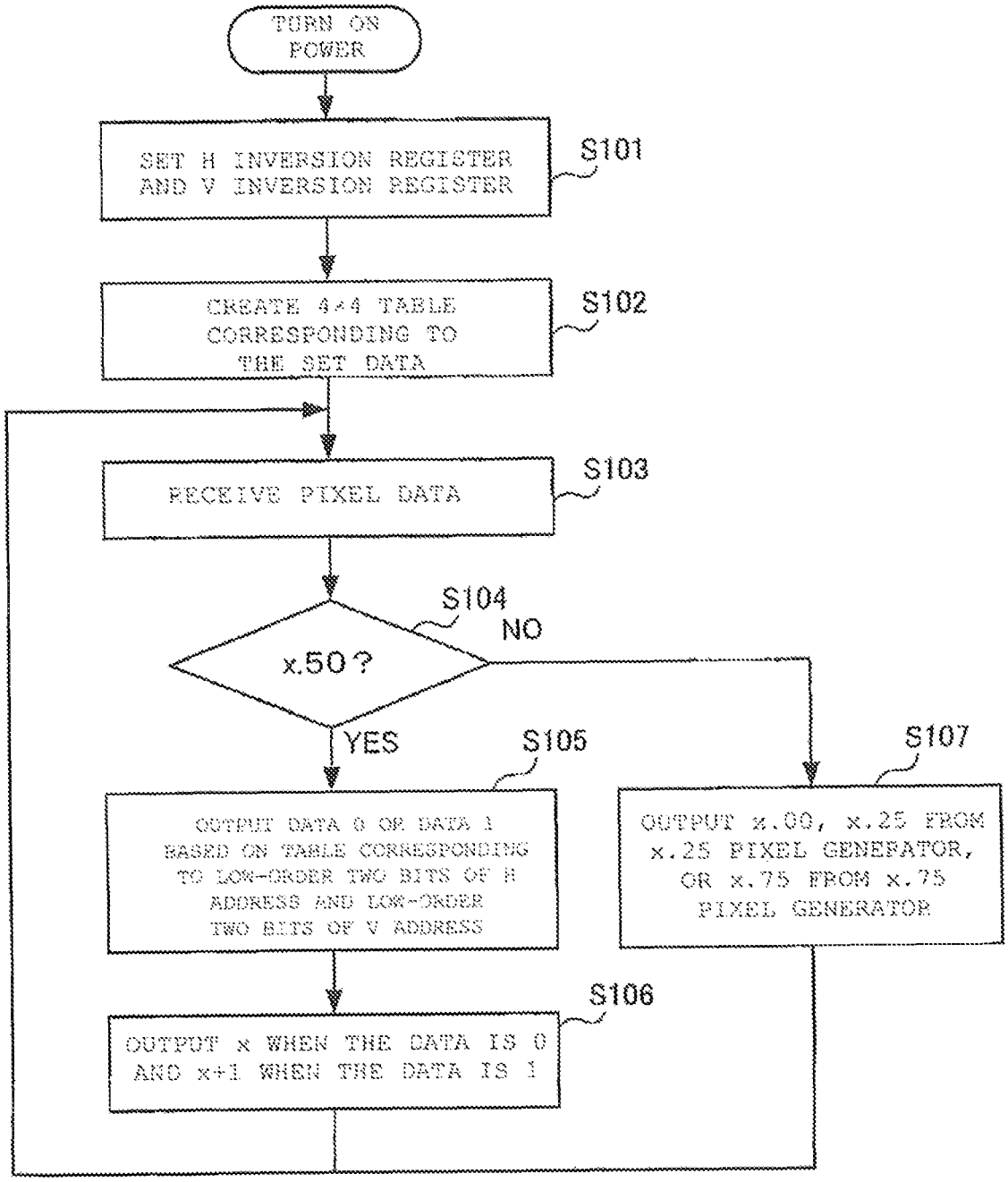
FIG. 10 is a flowchart showing processing using the x.50 pixel generator of FIG. 9.

FIG. 10 is a flowchart showing processing using the x.50 pixel generator 20, which is executed by the graphics chip 10 shown in FIG. 8. In the graphics chip 10, after a power supply is turned on, first, the H-inversion register and the V-inversion register are set through the LCD driving method recognition unit 12 (Step 101). Thereafter, as shown in FIG. 9, the 4×4 table 21 corresponding to the set data is created in the x.50 pixel generator 20 (Step 102). Next, the x.50 pixel generator 20 receives the input of the pixel data through the pixel data input unit 11 (Step 103), and it is determined in this pixel data input unit 11 whether or not the inputted pixel data is x.50 (Step 104). When the pixel data is not x.50, the pixel data which is x.00 is directly outputted through the pixel data input unit 11, or the pixel data which is x.25 or x.75 is outputted through the x.25 pixel generator 30 or the x.75 pixel generator 40, respectively (Step 107), and the processing returns to Step 103. When the pixel data is x.50 in Step 104, data 0 or data 1 is outputted by the selector 22 based on the 4×4 table 21 corresponding to the low-order two bits of the H address and the low-order two bits of the V address (Step 105). Then, the x.50 pixel generator 20 outputs x when the data is 0, and outputs x+1 when the data is 1 (Step 106). Then, the processing returns to Step 103, and the same processing is repeated therefrom.

As described above, for example, when the 64 gradation LCD for a notebook PC is made to display the 256 gradations, conventionally, the fixed pattern display error has sometimes occurred in the case of using a representative FRC method. However, in Embodiment 1, the combination of the LCD driving method and the FRC pattern is focused and optimized, thus making it possible to eliminate the occurrence of the fixed pattern. Specifically, the LCD driving device 1 recognizes the LCD driving method utilized by the LCD module 2 connected thereto, and performs control to generate the same FRC pattern as that of the recognized LCD driving method. In such a way, when displaying the x.50-th gradation such as the 62.5th gradation, two types of the x.50-th gradations can be prevented from occurring, and the fixed pattern is restricted from occurring.

In Embodiment 1, description has been made for the technology for eliminating the fixed pattern occurring in the x.50-th gradation such as, for example, the 62.5-th gradation. In Embodiment 2, description has been made for a technology for restricting a dynamic pattern occurring in the case other than where a mixture ratio of the gradations is 1:1, for example, in the 62.75th gradation and the 62.25th gradation. Note that like reference numerals are used for like functions as in Embodiment 1, and here, detailed description thereof will be omitted.

Before providing a detailed description of the embodiments to be discussed below, it will aid understanding such embodiments to first describe a display error of the dynamic pattern.

Figure 11:
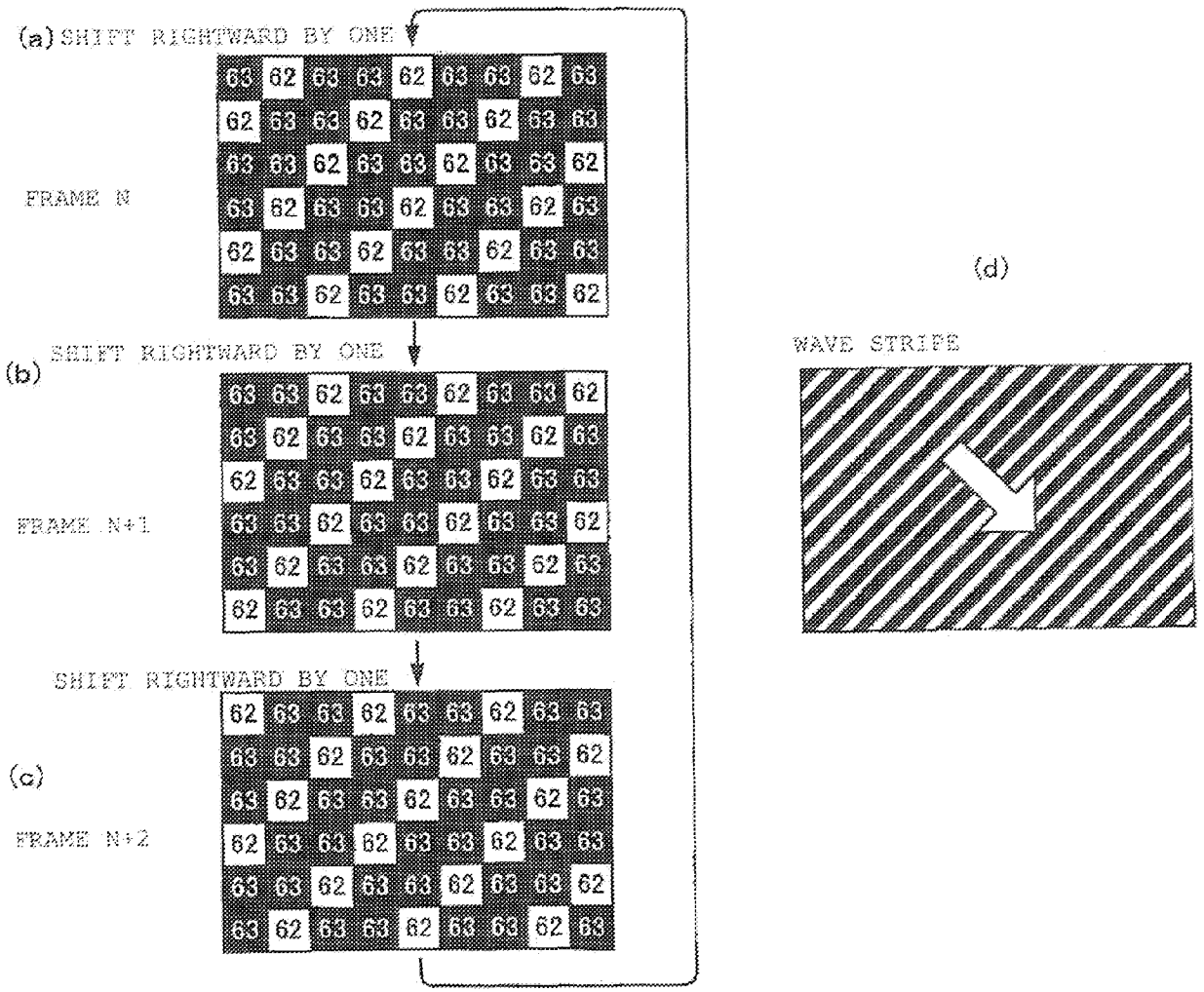
FIGS. 11(*a*) to 11(*d*) are diagrams used in explaining a cause of a dynamic pattern display error, for example, when a 64 gradation LCD for a notebook PC is used to display 256 gradations by using a typical FRC method.

FIGS. 11(*a*) to 11(*d*) are views for explaining a cause of the dynamic pattern display error, for example, when the 64 gradation LCD for the notebook PC is made to display the 256 gradations by using the representative FRC method. In the case where two types of gradations here are represented as the A-th gradation and the B-th gradation, the dynamic pattern occurring here may occur when a mixture ratio of an A-th gradation and a B-th gradation is other than 1:1, for example, 1:2, 1:3, 3:1, 2:1 or the like. In FIGS. 11(*a*) to 11(*d*), the case where the 63rd gradation and the 62nd gradation have the mixture ratio of 2:1 is taken as an example. Here, the A and B are the sequential numbers more than or equal to 0 determined by the gradations supported by the display.

FIG. 11(*a*) shows an example of the FRC in the case of the frame N. When the ratio of the 63rd gradation and the 62nd gradation is 2:1 on the screen, an oblique stripe pattern as illustrated occurs. Even in other arrays, predetermined stripe patterns will be made. Furthermore, when this pattern shown in FIG. 11(*a*) is shifted to the right by one line, the pattern becomes as shown in FIG. 11(*b*). When this pattern is further shifted to the right by another line, the pattern becomes as shown in FIG. 11(*c*). As described above, when the pattern is merely shifted to the right, the fixed pattern merely flows, and a wave stripe as shown in FIG. 11(*d*) occurs. Specifically, what is taken as a first cause of the dynamic pattern is that the array of the two gradations on the screen makes the oblique pattern when the two gradations have a mixture ratio of other than 1:1 (for example, 2:1). Moreover, what is taken as a second cause is that the fixed pattern caused by the first cause is merely seen as flowing because the pattern has heretofore been merely shifted to the right.

Figure 12:
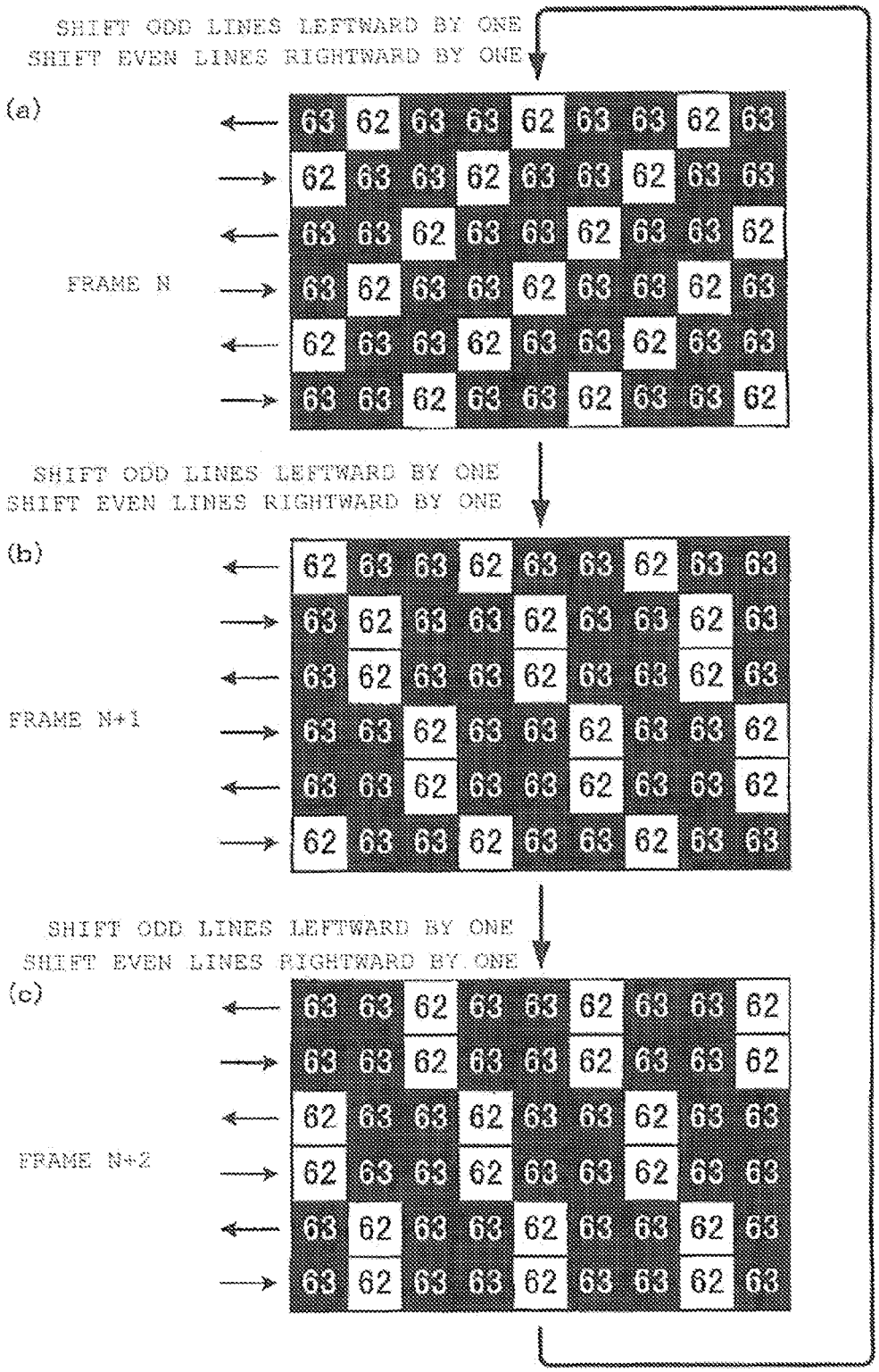
FIGS. 12(*a*) to 12(*c*) are diagrams for explaining a method of FRC in accordance with embodiments of the present invention.
Figure 13:
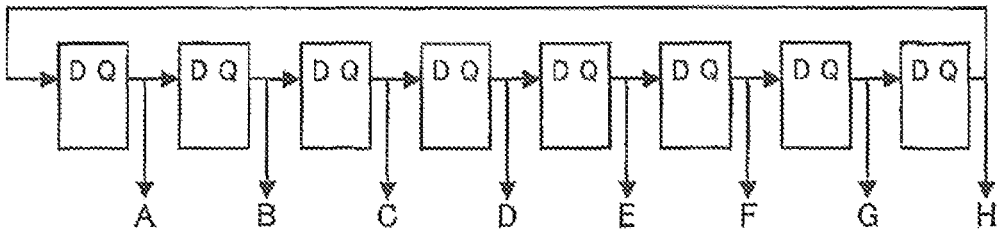
FIGS. 13(*a*) and 13(*b*) are diagrams used in explaining an implementation method of a circuit when two types of gradations are mixed in a ratio of 1:7.

FIGS. 12(*a*) to 12(*c*) are views for explaining an improved FRC method in accordance with a second, and further, embodiment of the present invention. In order to solve the aforementioned two causes, in Embodiment 2, it has been first determined that the pattern is to be made such that the pattern is not seen as a fixed pattern by making the pattern random. Moreover, in order to prevent the pattern from being seen as flowing in a certain direction, it has been second examined that shifting directions of lines adjacent to each other is reversed. For this purpose, in Embodiment 2, the shifting directions of the lines are reversed for each frame depending on whether the lines are odd or even. For example, the odd lines are shifted leftward, and the even lines are shifted rightward. First, in the pattern shown in FIG. 12(*a*), which is the frame N, the odd lines are shifted leftward, and the even lines are shifted rightward. Then, in the frame N+1, the pattern is converted as shown in FIG. 12(*b*). Moreover, the odd lines are shifted leftward, and the even lines are shifted rightward. Then, in the frame N+2, the pattern is converted as shown in FIG. 12(*c*). In such a way, the shifting directions of the Odd H lines and Even H lines are changed leftward and rightward, respectively. Thus, the pattern is made random, and is restricted from being seen as the fixed pattern. Moreover, the shifting directions of the adjacent lines are reverse, and accordingly, the pattern can be prevented from being seen as flowing in the certain direction. FIGS. 13(*a*) and 13(*b*) are diagrams for explaining an implementation method of a circuit when two types of gradations are mixed in a ratio of 1:7. FIG. 13(*a*) shows an 8-bit ring counter which is an example of the circuit. FIG. 13(*b*) shows an example of an 8×8 tile table. In FIG. 13(*a*), eight registers are provided, and an 8-bit ring counter in which A, B, C, D, E, F, G or H is switched On in this order is formed. Then, an output of this 8-bit ring counter is connected to the 8×8 tile table shown in FIG. 13(*b*), and thus the Odd H lines and Even H lines can be shifted in the directions reverse to each other. The entire screen can be configured by repeating the 8×8 tile table as described above.

According to the implementation method as shown in FIGS. 13(*a*) and 13(*b*), even when the two gradations are mixed in the ratio of 1:7, the circuit substantially added is eight registers, which is the minimum necessary. Moreover, an increase of power consumption can be minimized. Although there is a method having eight tile tables, the eight tile tables and a switching circuit are required, leading to a scale increase of the circuit. According to the method shown in FIGS. 13(*a*) and 13(*b*), it is made possible to remove the wave without raising the screen frequency while restricting the scale of the circuit.

Next, a system configuration to which Embodiment 2 is applied will be described by using an image display system shown in FIG. 7. A function of Embodiment 2 is realized by the graphics chip 10 of the LCD driving device 1 shown in FIG. 7. However, the 4-bit register is not necessary if the graphics chip 10 serves only for the function of Embodiment 2. Moreover, Embodiment 2 is one to be applied when the mixture ratio of the A-th gradation and the B-th gradation is other than 1:1, and is realized by the x.25 pixel generator 30 and the x.75 pixel generator 40, which are shown in FIG. 8.

Figure 14:
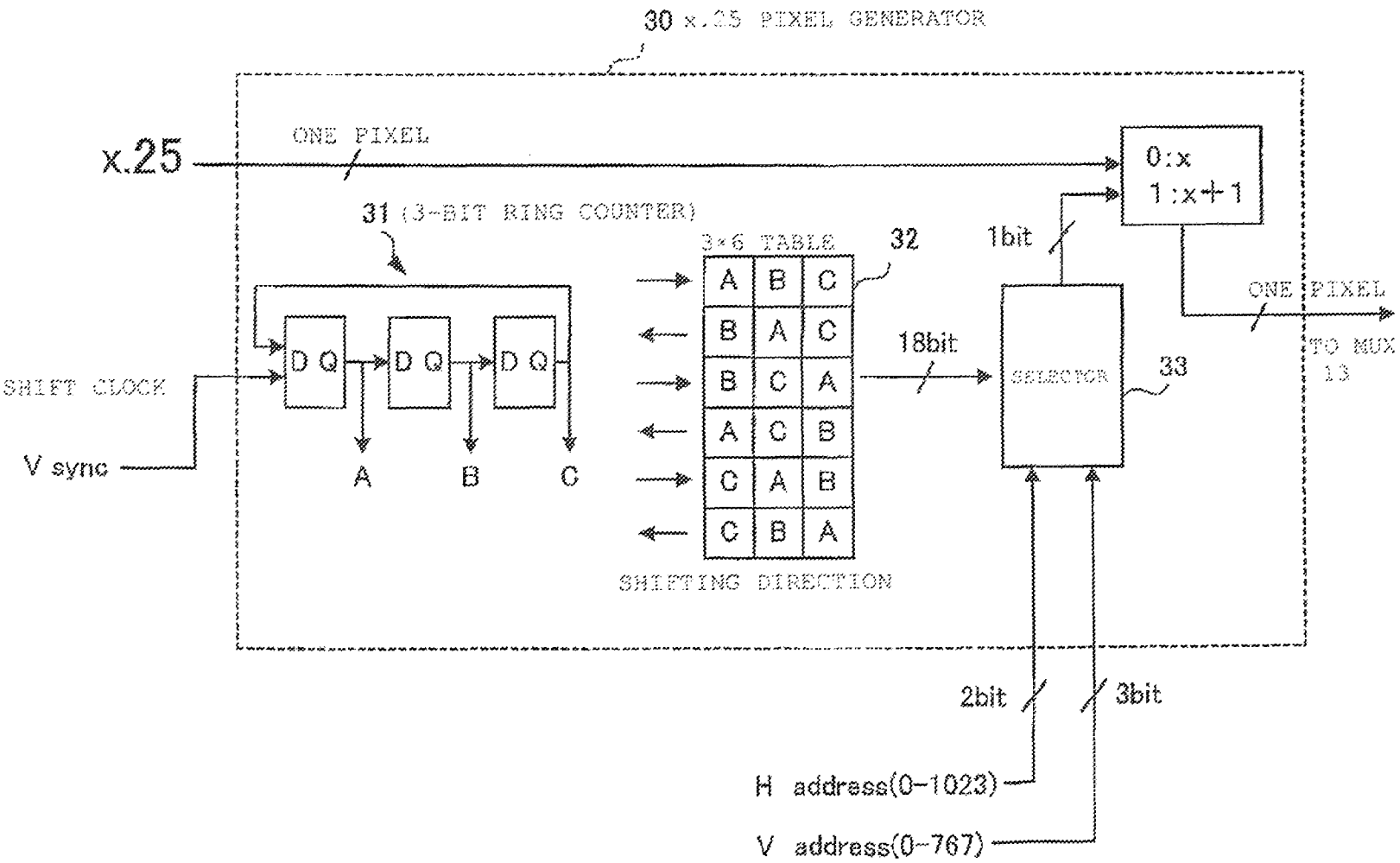
FIG. 14 is a block diagram showing an exemplary x.25 pixel generator in accordance with embodiments of the present invention.

FIG. 14 is a diagram showing an example of function blocks of the x.25 pixel generator 30 as a characteristic configuration in Embodiment 2. The x.75 pixel generator 40 can also be realized by a similar configuration. The x.25 pixel generator 30 includes three registers. The x.25 pixel generator 30 includes a 3-bit ring counter 31 in which A, B or C is switched On in this order, a 3×6 table 32 which is a tile table for alternately shifting the Odd H lines and the Even H lines, and a selector 33 for outputting data 0 or data 1 based on the 3×6 table 32 corresponding to two bits of an H address and three bits of a V address. This 3-bit ring counter 31 operates by shift clock of a vertical synchronization signal (V sync). To the x.25 pixel generator 30, inputted is the pixel data composed of the 63, 62.75, 62.5, 62.25 . . . , 0.50, 0.25 and 0-th gradations through the pixel data input unit 11 shown in FIG. 8. From the x.25 pixel generator 30, the pixel data of the 63, 62 . . . 2nd, 1st and 0-th gradations is outputted for each pixel to the multiplexer (MUX) 13 by the function shown in FIG. 14.

Figure 15:
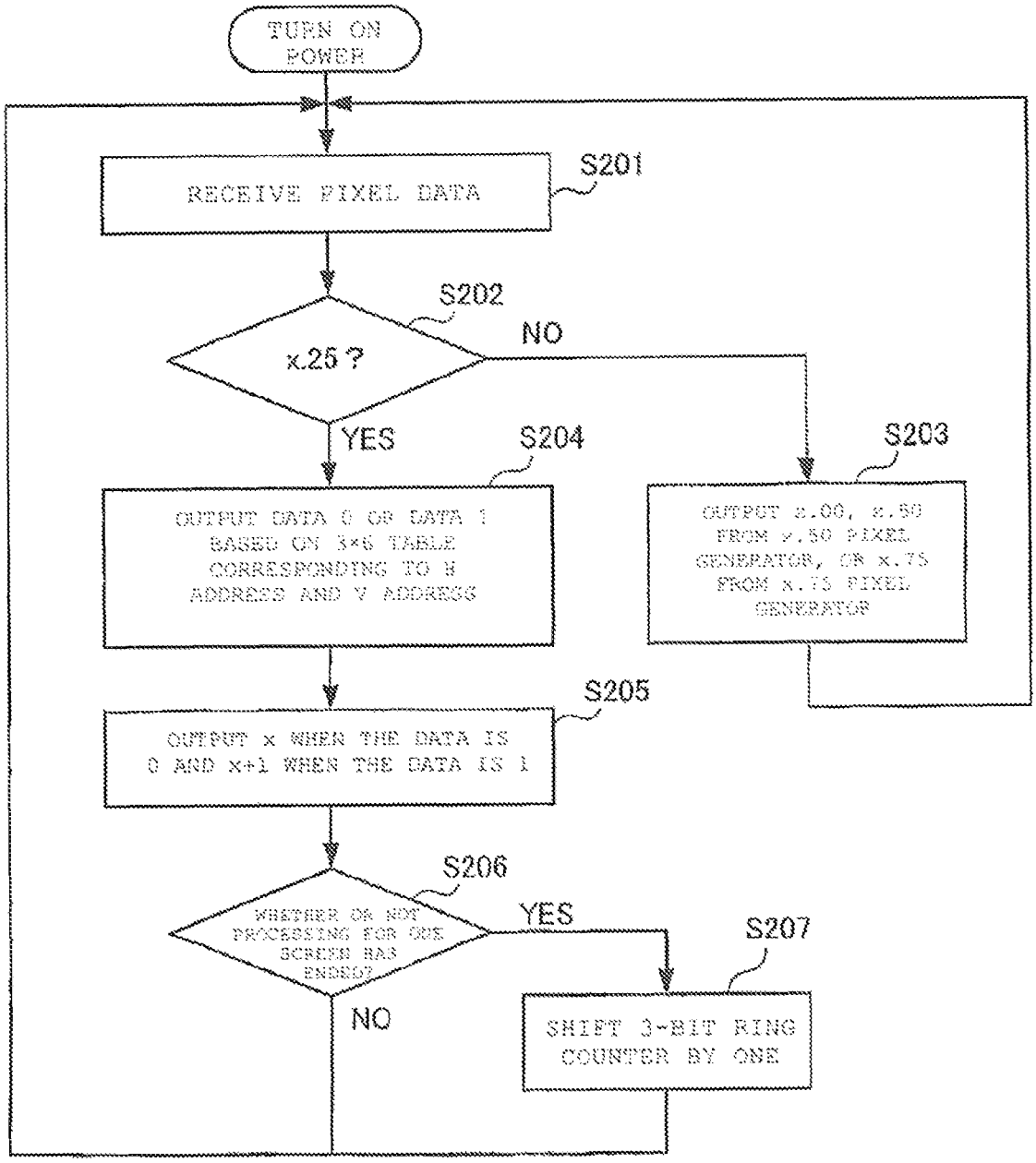
FIG. 15 is a flowchart showing processing using the x.25 pixel generator of FIG. 14.

FIG. 15 is a flowchart showing processing using the x.25 pixel generator 30, which is executed by the graphics chip 10 shown in FIG. 8. After the power supply is turned on, the graphics chip 10 receives the input of the pixel data through the pixel data input unit 11 (Step 201). Next, it is determined whether or not the inputted pixel data is x.25 (Step 202). When the pixel data is not x.25, the pixel data which is x.00 is directly outputted through the pixel data input unit 11, or the pixel data which is x.50 or x.75 is outputted through the x.50 pixel generator 20 or the x.75 pixel generator 40, respectively (Step 203), and the processing returns to Step 201. When the pixel data is x.25 in Step 202, data 0 or data 1 is outputted from the selector 33 based on the 3×6 table 32 corresponding to the H address and the V address (Step 204). Then, the x.25 pixel generator 30 outputs x when the data is 0, and outputs x+1 when the data is 1 (Step 205). Here, it is determined whether or not the processing for one screen has ended. In other words, it is determined whether or not the processing for the V lines has been completed (Step 206). When the processing for one screen has not ended yet, the processing directly returns to Step 201, and the same processing is repeated therefrom. When the processing for one screen has ended, the 3-bit ring counter 31 is shifted by one (Step 207). Then, the processing returns to Step 201, and the same processing is repeated therefrom.

As described above in detail, in the new FRC method of Embodiment 2, the even lines and the odd lines are alternately shifted when the mixture ratio of the A-th gradation and the B-th gradation is other than 1:1 (for example, 1:2, 1:3, 3:1, 2:1 or the like). Accordingly, the pattern is made random, and therefore, it is possible to eliminate the problem that the pattern is seen as the fixed pattern. Moreover, since the shifting directions of the adjacent lines are reverse, it is made possible to eliminate the problem that the pattern is seen as flowing in the certain direction. In this case, it is satisfactory that the mixture ratio is set as designed when the pattern is viewed in the H line direction. As described above, it can be said that Embodiment 2 is a method that is the simplest and the easiest to introduce among numerous methods of removing noise in the dynamic pattern display. Note that, while the shifting in the H direction has been described in the aforementioned example, it is also possible to employ Embodiment 2 for shifting in the V direction or shifting in a 45-degree direction. Moreover, it is possible to apply Embodiment 2 not only to the LCD but also to other displays.

In the technology of Embodiment 2, a configuration is made such that the pattern is made random by alternately shifting the even lines and the odd lines. In this Embodiment 3, a technology for restricting interference fringes observed when Embodiment 2 is applied to the display driven by alternating current (performing polarity inversion), such as, for example, the LCD 9, will be described. Note that like reference numerals are used for like functions as in Embodiment 1 and/or Embodiment 2, and here, detailed description thereof will be omitted.

Figure 16:
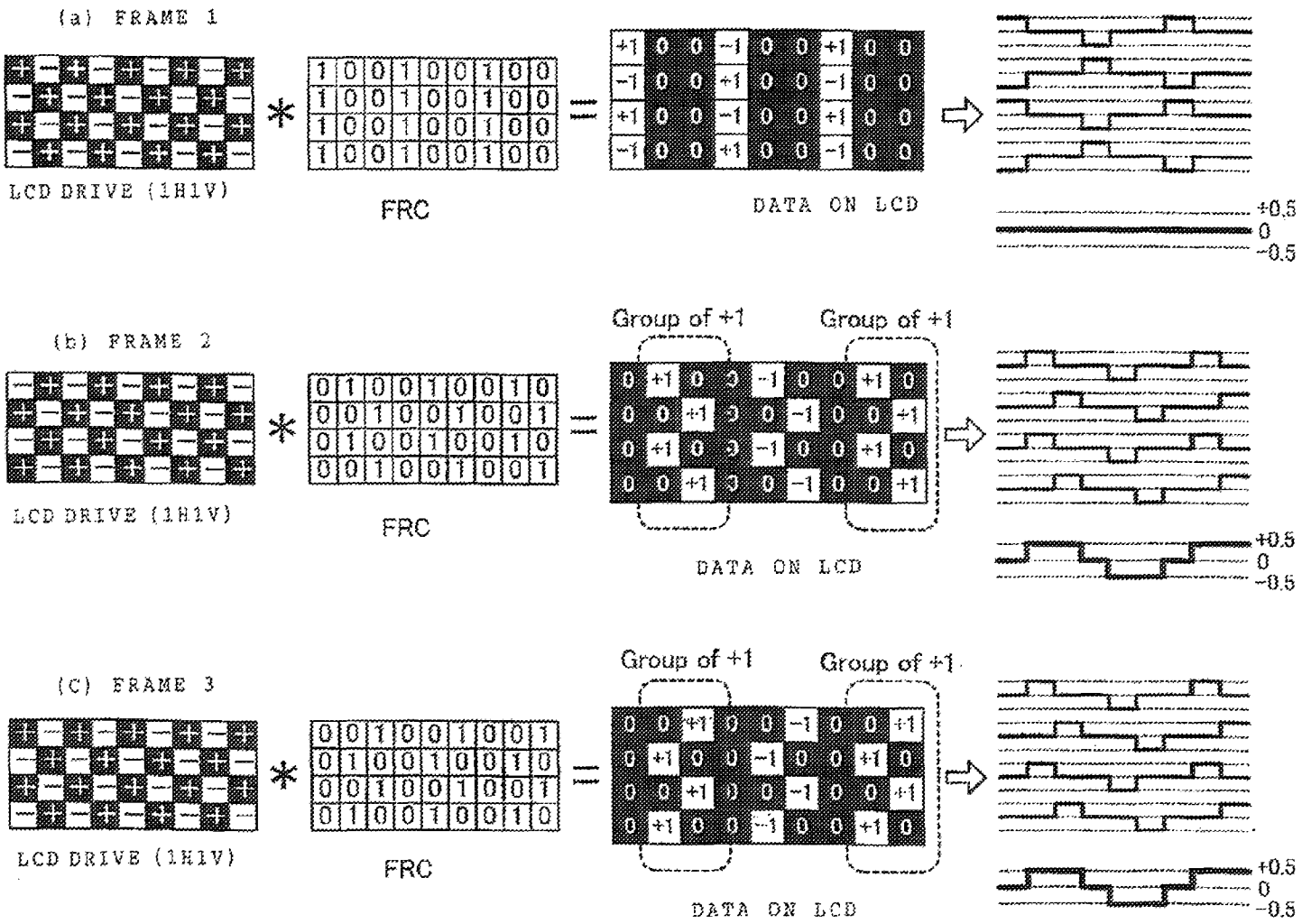
FIGS. 16(*a*) to 16(*c*) are diagrams used in explaining a problem which occurs when a typical FRC method is used which alternately shifts lines for each line.
Figure 17:
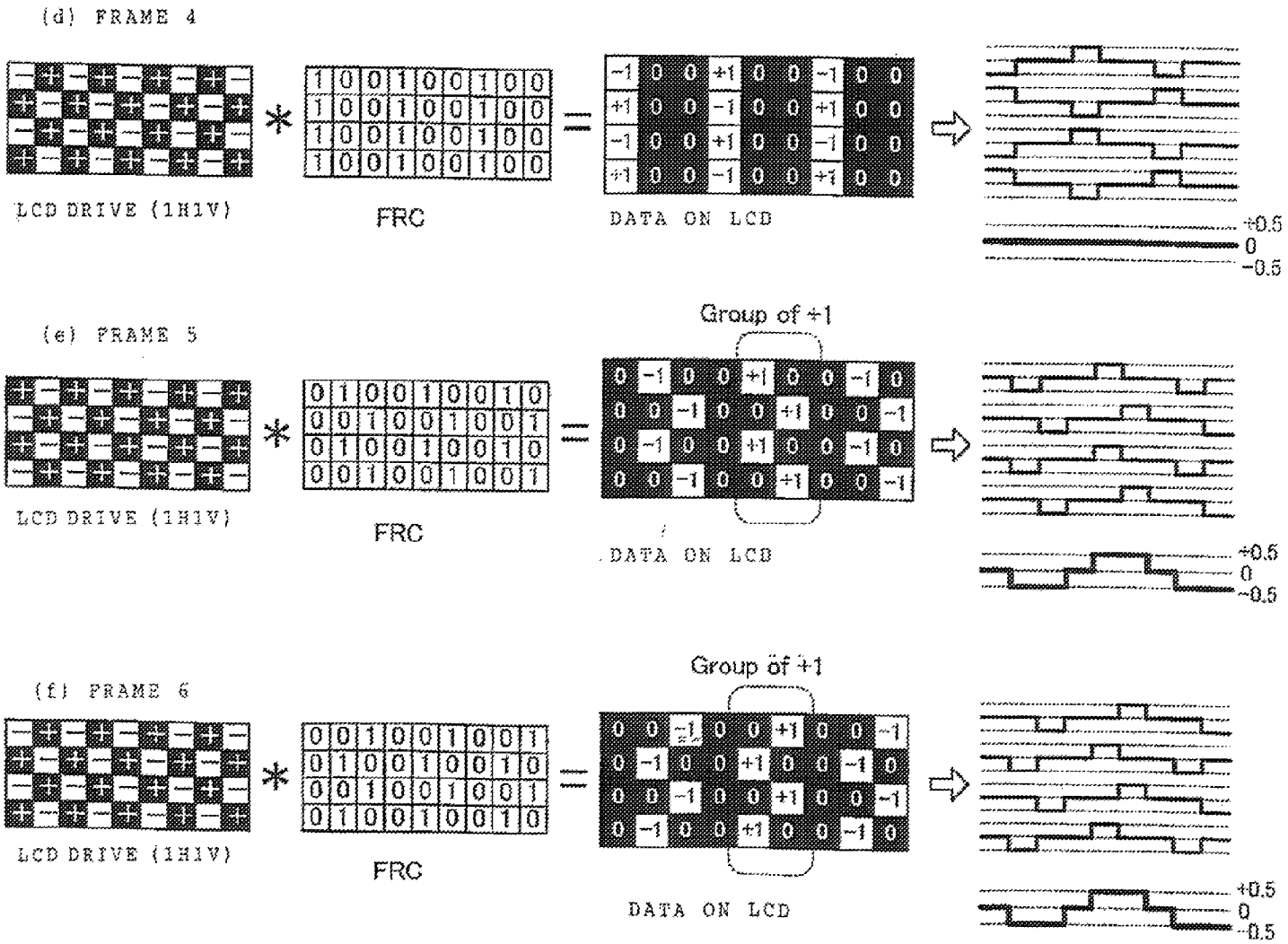
FIGS. 17(*d*) to 17(*f*) are diagrams used in further explaining a problem which occurs when a typical FRC method is used which alternately shifts lines for each line.

FIGS. 16(*a*) to 16(*c*) and FIGS. 17(*d*) to 17(*f*) are views for explaining a problem when the FRC method as shown in Embodiment 2, which shifts the lines by every one line, is employed in the case where, for example, the LCD 9 is used as the display. The LCD drive taken here as an example is the 1H1V inversion LCD drive, where the polarities are inverted for each frame. When LCD drive shown at the leftmost end of FIG. 16 is multiplied by the FRC pattern composed of 1 and 0 in each frame, data on the LCD, which is represented by +1, −1 and 0, is obtained. When levels by the obtained data on the LCD are plotted for each line, a result thereof becomes like the rightmost end of FIG. 16. In a frame 1 shown in FIG. 16(*a*), levels of vertical lines (lines extended in the vertical direction: V lines) are neutralized for each vertical line, and a result obtained by adding together levels of the data of the respective pixels becomes 0. Thereafter, in the FRC pattern of each frame, as shown in Embodiment 2, adjacent lines are shifted in directions reverse to each other in horizontal lines (lines extended in the horizontal direction: H lines). Here, odd lines are shifted rightward for each frame, and even lines are shifted leftward for each frame. As a result of this, in a frame 2 shown in FIG. 16(*b*) and a frame 3 shown in FIG. 16(*c*), groups of +1 and groups of −1 are undesirably present in the data on the LCD, which is obtained by multiplying the LCD drive and the FRC. Levels in the vertical direction in this case become as shown as the rightmost end. In the horizontal lines, there are spots where results obtained by adding together the levels of the data of the respective pixels become positive (+) and negative (−).

Moreover, in FIGS. 17(*d*) to 17(*f*), frames 4 to 6 are shown. Levels in the vertical direction are neutralized in FIG. 17(*d*), and however, in the frame 5 shown in FIG. 17(*e*) and the frame 6 shown in FIG. 17(*f*), the groups of +1 and the groups of −1 are present in the data on the LCD, which is obtained by multiplying the LCD drive and the FRC. Such a difference in level for each vertical line appears as interference noise. When the LCD 9 is driven at 60 Hz, data waves from the left and the right collide against each other, and thus standing wave noise (flashing noise) of 10 Hz, which forms one cycle by six frames, occurs.

Accordingly, in Embodiment 3, the same patterns are arranged for positive and negative pixels adjacent to each other in the vertical direction, and this relationship is maintained. Thus, the lines of the FRC are shifted such that the polarities which are positive and negative are always neutralized in the vertical lines.

Figure 18:
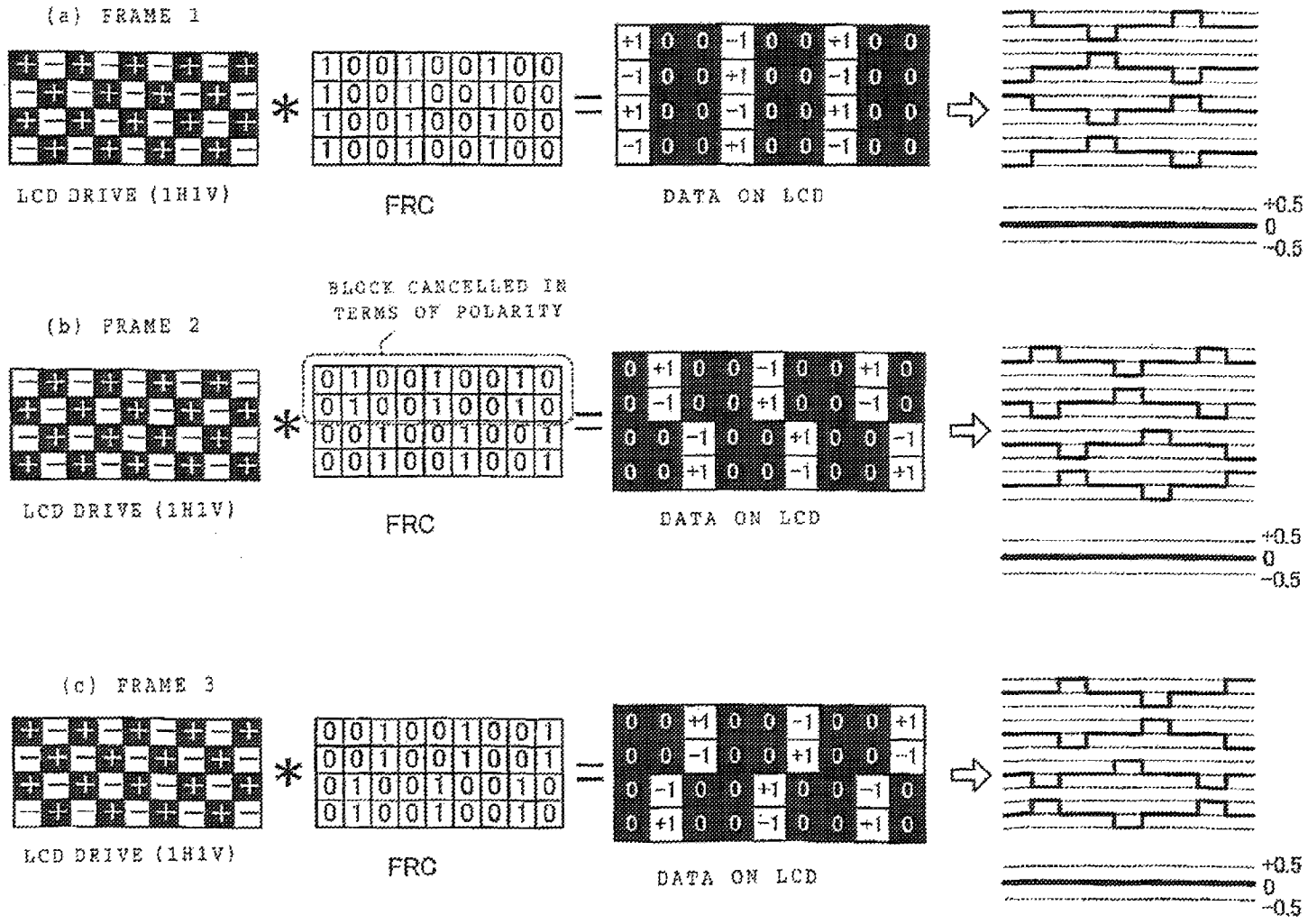
FIGS. 18(*a*) to 18(*c*) are diagrams used in explaining an FRC method according to embodiments of the present invention.
Figure 19:
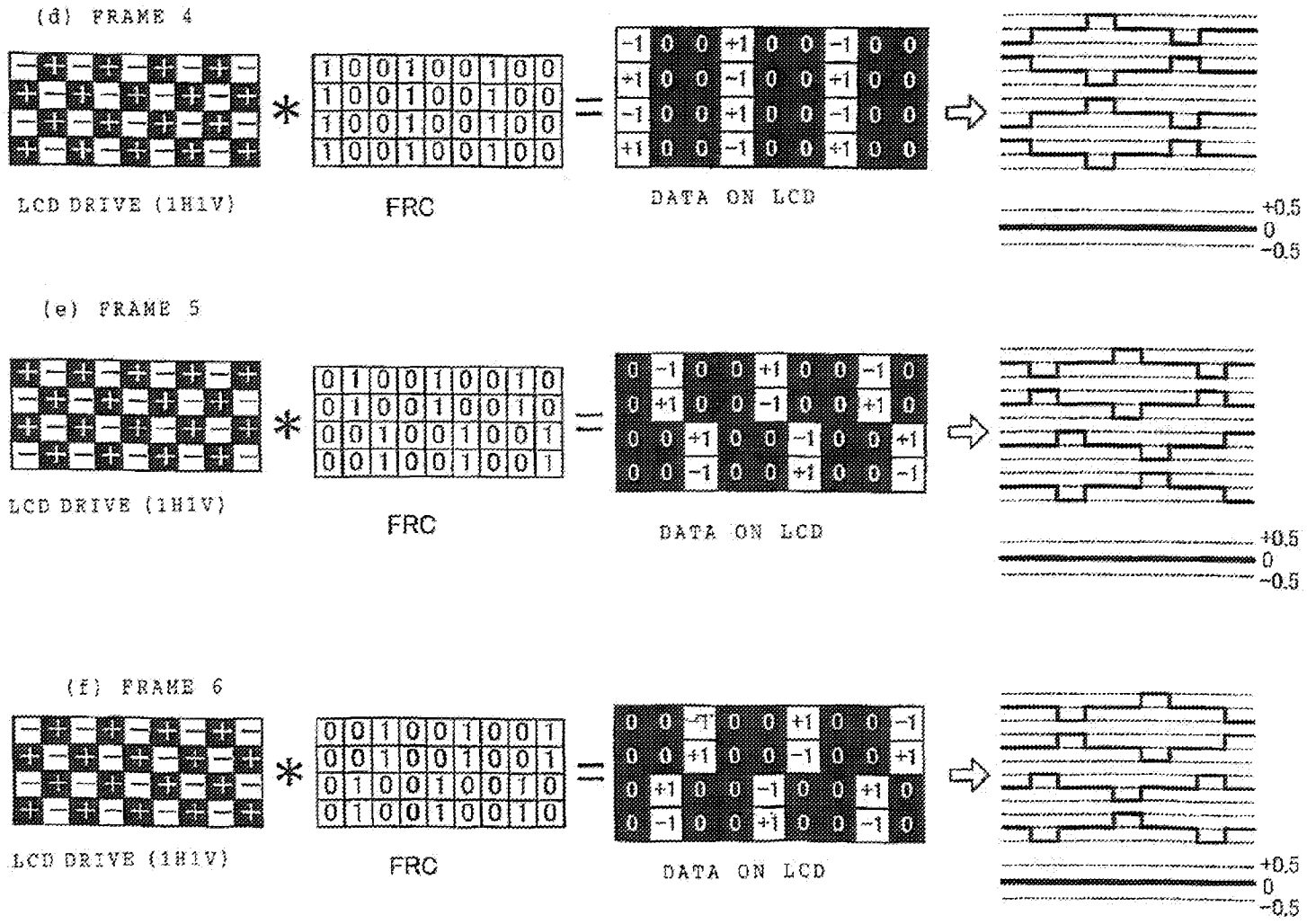
FIGS. 19(*d*) to 19(*f*) are diagrams used in further explaining an FRC method according to embodiments of the present invention.

FIGS. 18(*a*) to 18(*c*) and FIGS. 19(*d*) to 19(*f*) are views for explaining an FRC method shown in Embodiment 3. FIGS. 18(*a*) to 18(*c*) show the first frame to the third frame, and FIGS. 19(*d*) to 19(*f*) show the fourth to sixth frames. In this Embodiment 3, a configuration is adopted such that the same patterns are arranged for the positive and negative pixels adjacent to each other in the vertical direction and this relationship is maintained. More specifically, the first 2H lines (ODD 2H Lines) are shifted rightward, and the next 2H lines (EVEN 2H Lines) are shifted leftward.

For the frame 1 shown in FIG. 18(*a*), in the frame 2 shown in FIG. 18(*b*), the FRC data is shifted leftward and rightward by every two lines canceling the polarities, as blocks cancelled in terms of polarity. In FIG. 18(*b*), both of two lines which are the first block are shifted rightward by one, and both of two lines which are the next block are shifted leftward by one. With regard to the data on the LCD as the result of multiplying the LCD drive and the FRC data, +1 and −1 appear on the same positions in the vertical lines (V lines) by every two lines. As a result of this, as shown in the rightmost end, the levels are neutralized in all of the V lines when seen from the vertical direction, and the levels added together are maintained at 0. Similarly, also in FIG. 18(*c*), the same patterns are arranged for the positive and negative pixels vertically adjacent to each other, and while this relationship is being maintained, the FRC data is shifted leftward and rightward. As a result of this, as shown in the rightmost end, results of the addition in the V lines are maintained at 0.

Moreover, in FIGS. 19(*d*) to 19(*f*), frames 4 to 6 are shown. In FIG. 19(*d*), the polarities of the LCD drive are inverted from those in FIG. 18(*c*), and moreover, the FRC data is shifted leftward and rightward one by one for each block of two lines. In such a case also, the data on the LCD is neutralized in the direction of the V lines. Moreover, in the frame 5 shown in FIG. 19(*e*) and the frame 6 shown in FIG. 19(*f*), the polarities of the LCD drive are inverted for each frame, and the FRC data is shifted leftward and rightward one by one for each block of two lines. As a result of this, the data on the LCD is neutralized in the direction of the V lines in each frame.

In such a way, in the example shown in FIG. 19, in order to prevent the fixed pattern from flowing in a certain direction, a block of a specific two lines are shifted rightward, and a block of the next two lines is shifted leftward. Thus, the polarities which are positive and negative in the vertical lines (V lines) are always cancelled, and accordingly, it is made possible to restrict the standing wave from occurring.

Figure 20:
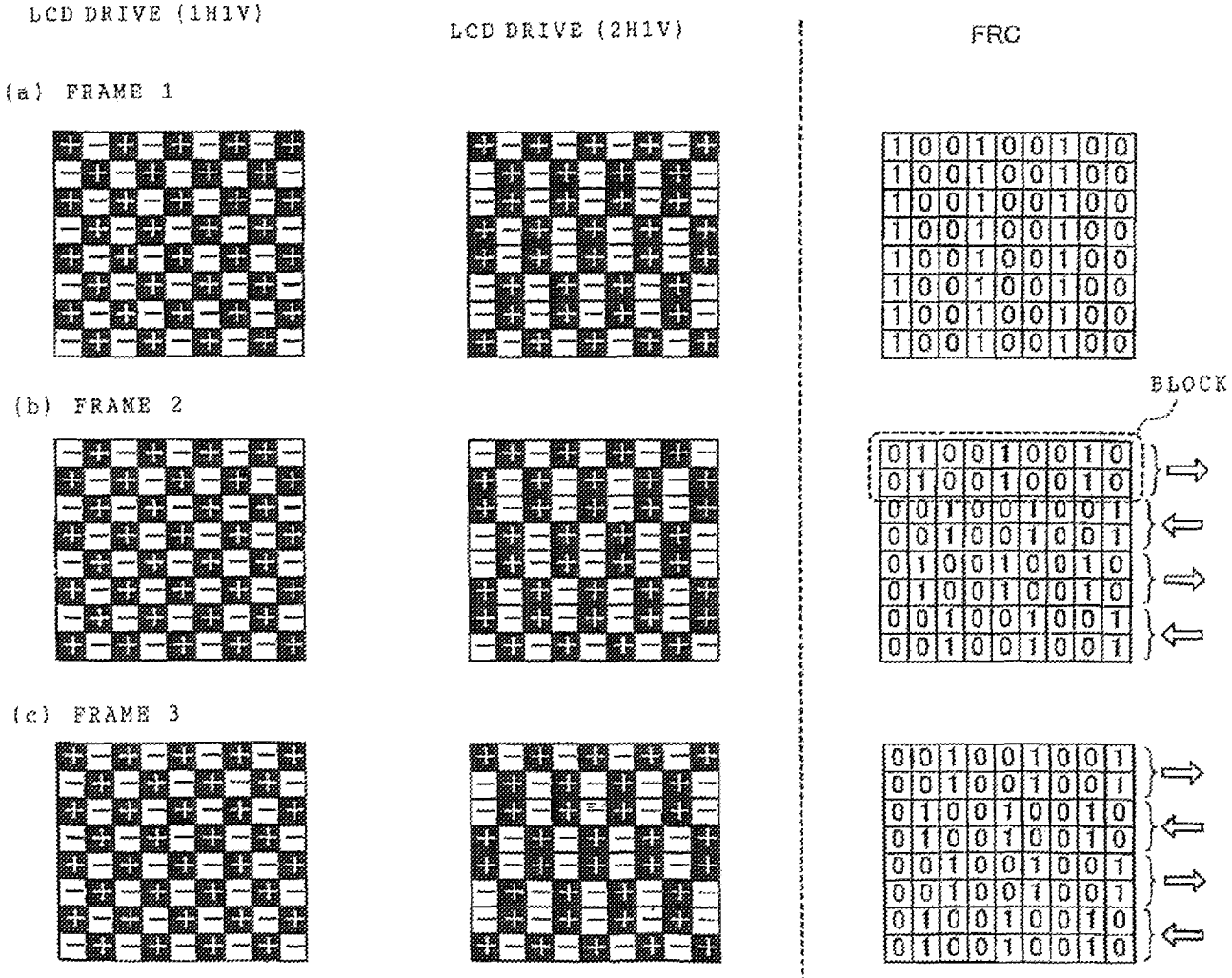
FIGS. 20(*a*) to 20(*c*) are diagrams showing relationships between polarities by LCD drive of 2H1V inversion and FRC data according to embodiments of the present invention.

FIGS. 20(*a*) to 20(*c*) are views showing relationships between polarities by the LCD drive of the 2H1V inversion and the FRC data to which Embodiment 3 is applied. Here, for comparison, polarities by the LCD drive of the 1H1V inversion are shown. FIG. 20(*a*) shows a frame 1, FIG. 20(*b*) shows a frame 2 next to the frame 1, and FIG. 20(*c*) shows a frame 3 next to the frame 2. In the LCD drive of the 2H1 V inversion, which is shown in FIG. 20, the same polarities are used for each of lines (H lines) of which number is 1, 2, 2, 2 and 1. Specifically, the same polarities are given in the vertical direction for each 1H line on upper and lower ends and for each set of 2H lines on a center portion.

In the frame 2 shown in FIG. 20(*b*), the polarities are inverted from those of the LCD drive shown in FIG. 20(*a*). In this case, the corresponding FRC data sets each set of horizontal two lines (2H lines) as a block. In the LCD drive, in a block of the two horizontal lines, the upper and lower pixels have the positive polarity and the negative polarity respectively, and the 2H lines always cancel the vertical polarities thereof. In the corresponding FRC data, shifting with these polarities taken into consideration is performed. Thus, even in the case of using the LCD 9 driven by alternating current, the polarities are neutralized in the vertical direction, thus making it possible to restrict interference specific to the LCD.

Figure 21:
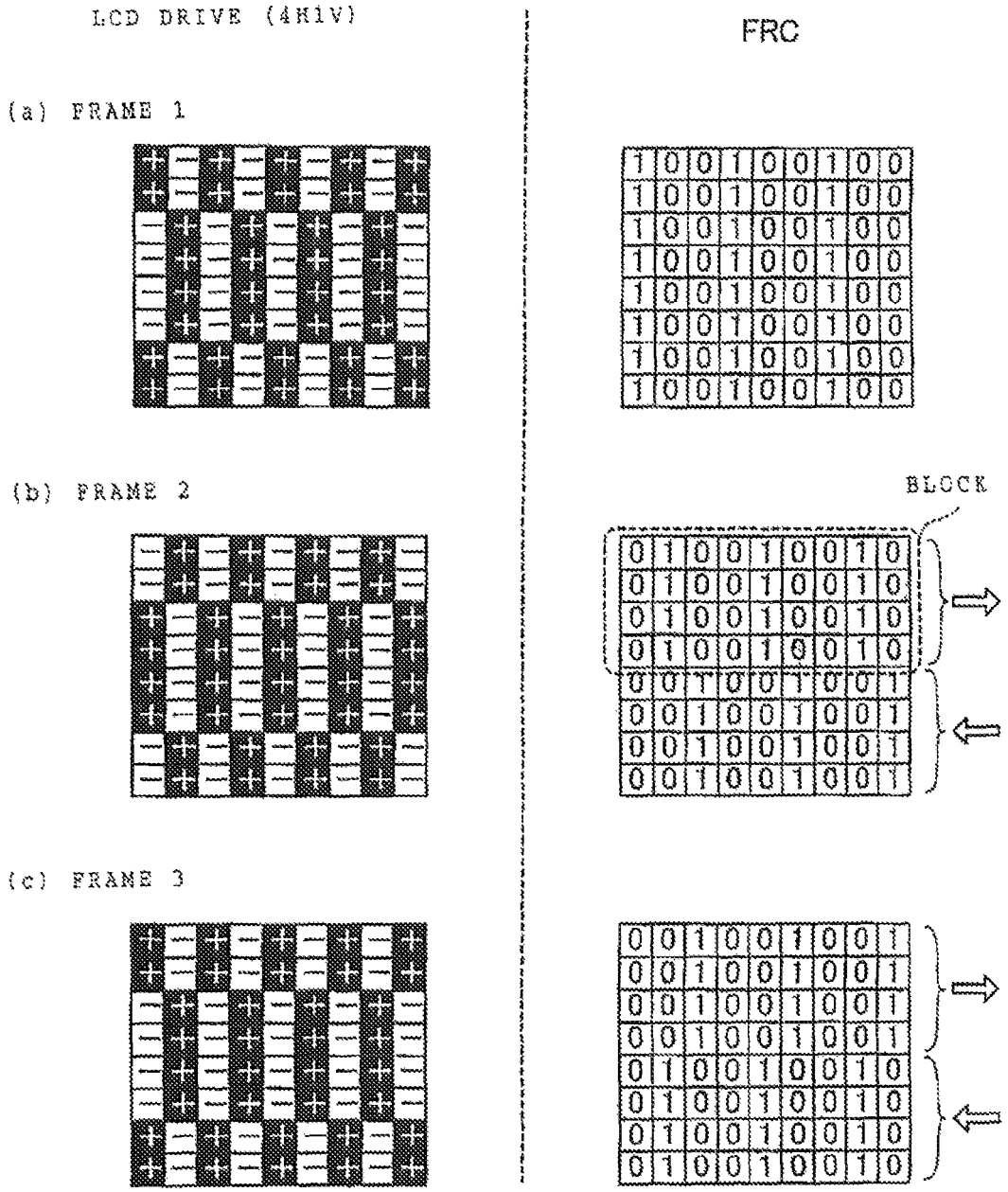
FIGS. 21(*a*) to 21(*c*) are views showing relationships between polarities by LCD drive of 4H1V inversion and FRC data according to embodiments of the present invention.

FIGS. 21(*a*) to 21(*c*) are views showing relationships between polarities by the LCD drive of the 4H1V inversion and the FRC data to which Embodiment 3 is applied. FIG. 21(*a*) shows a frame 1, FIG. 21(*b*) shows a frame 2 next to the frame 1, and FIG. 21(*c*) shows a frame 3 next to the frame 2. In the LCD drive of the 4H1V inversion, which is shown in FIG. 21, the same polarities are used for each of lines (H lines) of which number is 2, 4 and 2. Specifically, the same polarities are given in the vertical direction for each set of 2H lines on upper and lower ends and for each set of 4H lines on a center portion.

In the frame 2 shown in FIG. 21(*b*), the polarities are inverted from those of the LCD drive shown in FIG. 21(*a*). In this case, the corresponding FRC data sets each set of horizontal four lines (4H lines) as a block. In the LCD drive, in a block of the four horizontal lines, two of vertical four pixels have the positive polarity and the other two have the negative polarity, and the 4H lines always cancel the vertical polarities thereof. In the corresponding FRC data, shifting in which four lines with these polarities taken into consideration are set as a block is performed. Thus, even in the case of using the LCD 9 driven by alternating current, the polarities are neutralized in the vertical direction, thus making it possible to restrict the interference specific to the LCD.

Figure 22:
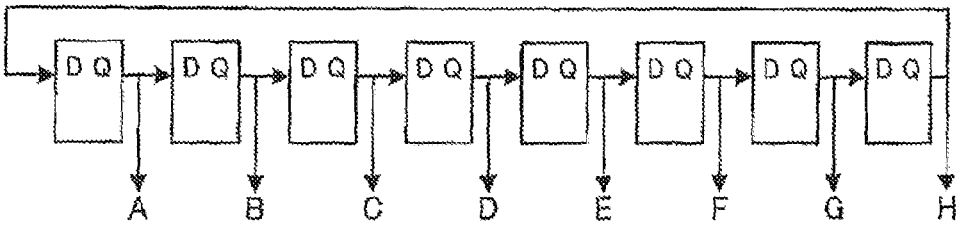
FIGS. 22(*a*) and 22(*b*) are diagrams for explaining an implementation method of a circuit when two types of gradations are mixed in a ratio of 1:7 in accordance with embodiments of the present invention.

FIGS. 22(*a*) and 22(*b*) are diagrams for explaining an implementation method of a circuit when two types of gradations are mixed in a ratio of 1:7 in Embodiment 3. FIG. 22(*a*) shows an 8-bit ring counter which is an example of the circuit. FIG. 22(*b*) shows an example of an 8×8 tile table. In FIG. 22(*a*), eight registers are provided, and an 8-bit ring counter in which A, B, C, D, E, F, G or H is switched On in this order is formed. Then, an output of this 8-bit ring counter is connected to the 8×8 tile table shown in FIG. 22(*b*), and thus the lines can be alternately shifted for each block of the lines neutralizing the polarities in the vertical direction. The entire screen can be configured by repeating the 8×8 tile table as described above.

According to the implementation method as shown in FIGS. 22(*a*) and 22(*b*), even when the two gradations are mixed in the ratio of 1:7, the circuit substantially added is eight registers, which is the minimum necessary. Moreover, an increase of power consumption can also be minimized. Although there is a method having eight tile tables, the eight tile tables and a switching circuit are required, leading to a scale increase of the circuit. According to the method shown in FIGS. 22(*a*) and 22(*b*), it is made possible to remove the wave without raising the screen frequency in a state of restricting the scale of the circuit.

Next, a system configuration to which Embodiment 3 is applied will be described by using the image display system shown in FIG. 7. A function of Embodiment 3 is realized by the graphics chip 10 of the LCD driving device 1 shown in FIG. 7. Moreover, Embodiment 3 is one to be applied on condition that the mixture ratio of the A-th gradation and the B-th gradation is other than 1:1 similarly to Embodiment 2, and is realized by the x.25 pixel generator 30 and the x.75 pixel generator 40, which are shown in FIG. 8.

Figure 23:
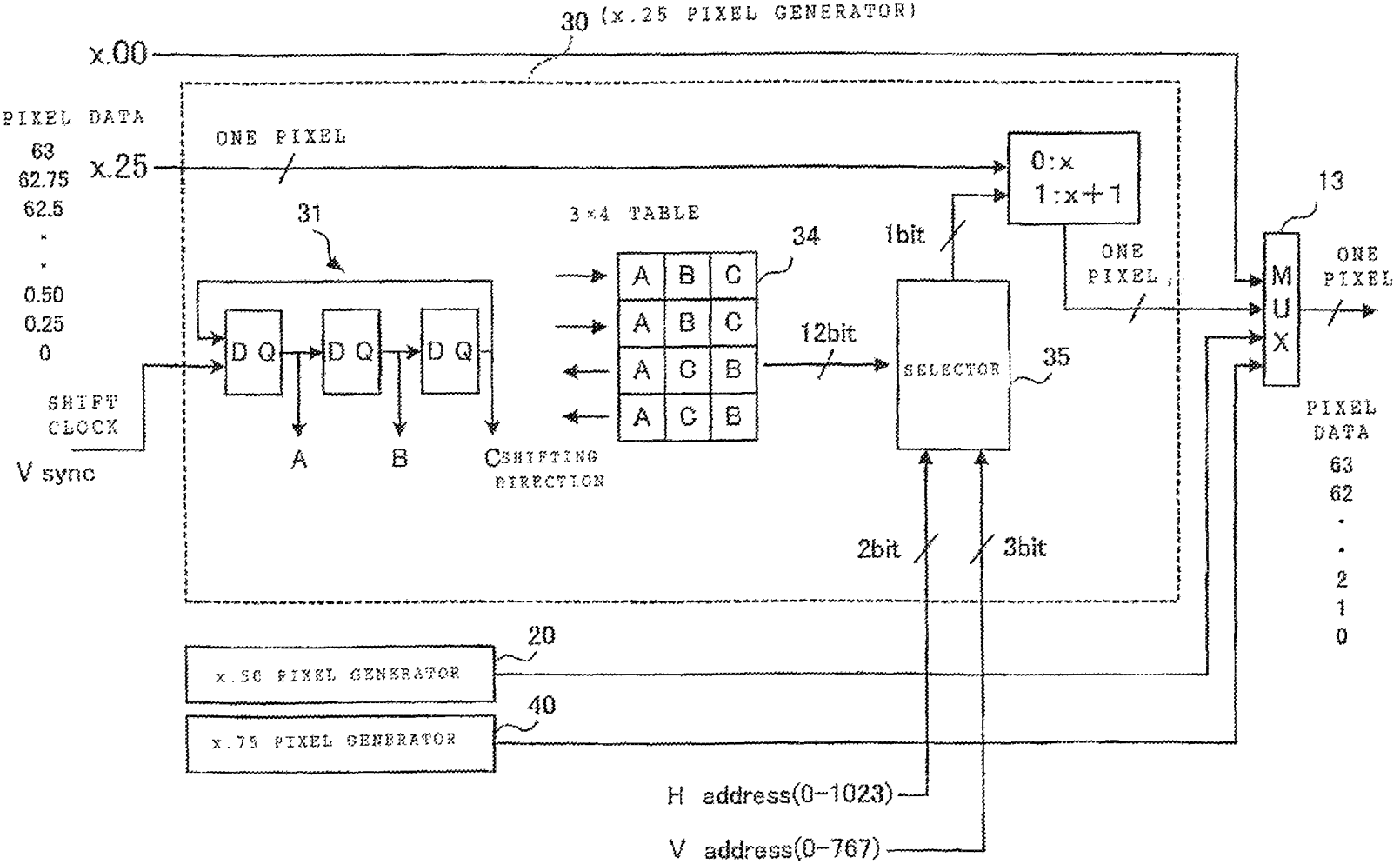
FIG. 23 is a block diagram showing an exemplary x.25 pixel generator in accordance with embodiments of the present invention.

FIG. 23 is a block diagram showing an exemplary x.25 pixel generator 30, as a configuration in Embodiment 3. The x.75 pixel generator 40 can also be realized by a similar configuration. The x.25 pixel generator 30 includes three registers. The x.25 pixel generator 30 includes a 3-bit ring counter 31 in which A, B or C is switched On in this order, a 3×4 table 34 which is a tile table for alternately shifting the block of the lines neutralizing the polarities in the vertical direction, and a selector 35 for outputting data 0 or data 1 based on the 3×4 table 34. This 3-bit ring counter 31 operates by shift clock of a vertical synchronization signal (V sync). To the x.25 pixel generator 30, inputted is the pixel data composed of the 63, 62.75, 62.5, 62.25 . . . , 0.50, 0.25 and 0-th gradations through the pixel data input unit 11 shown in FIG. 8. From the x.25 pixel generator 30, the pixel data of the 63, 62 . . . 2nd, 1st and 0-th gradations is outputted for each pixel to the multiplexer (MUX) 13. Moreover, to the multiplexer (MUX) 13, as well as the pixel of the x.25-th gradation is inputted from the x.25 pixel generator 30, the pixel of the x.50-th gradation is inputted from the x.50 pixel generator 20, and moreover, the pixel of the x.75-th gradation is inputted from the x.75 pixel generator 40. In the multiplexer (MUX) 13, an x.00 pixel inputted from the pixel data input unit 11 and the pixels generated individually by the respective generators are compiled into one, and pixel data expressed in a gradation corresponding to the LCD 9, for example, in one of the 0 to 63rd gradations is outputted for each pixel.

Figure 24:
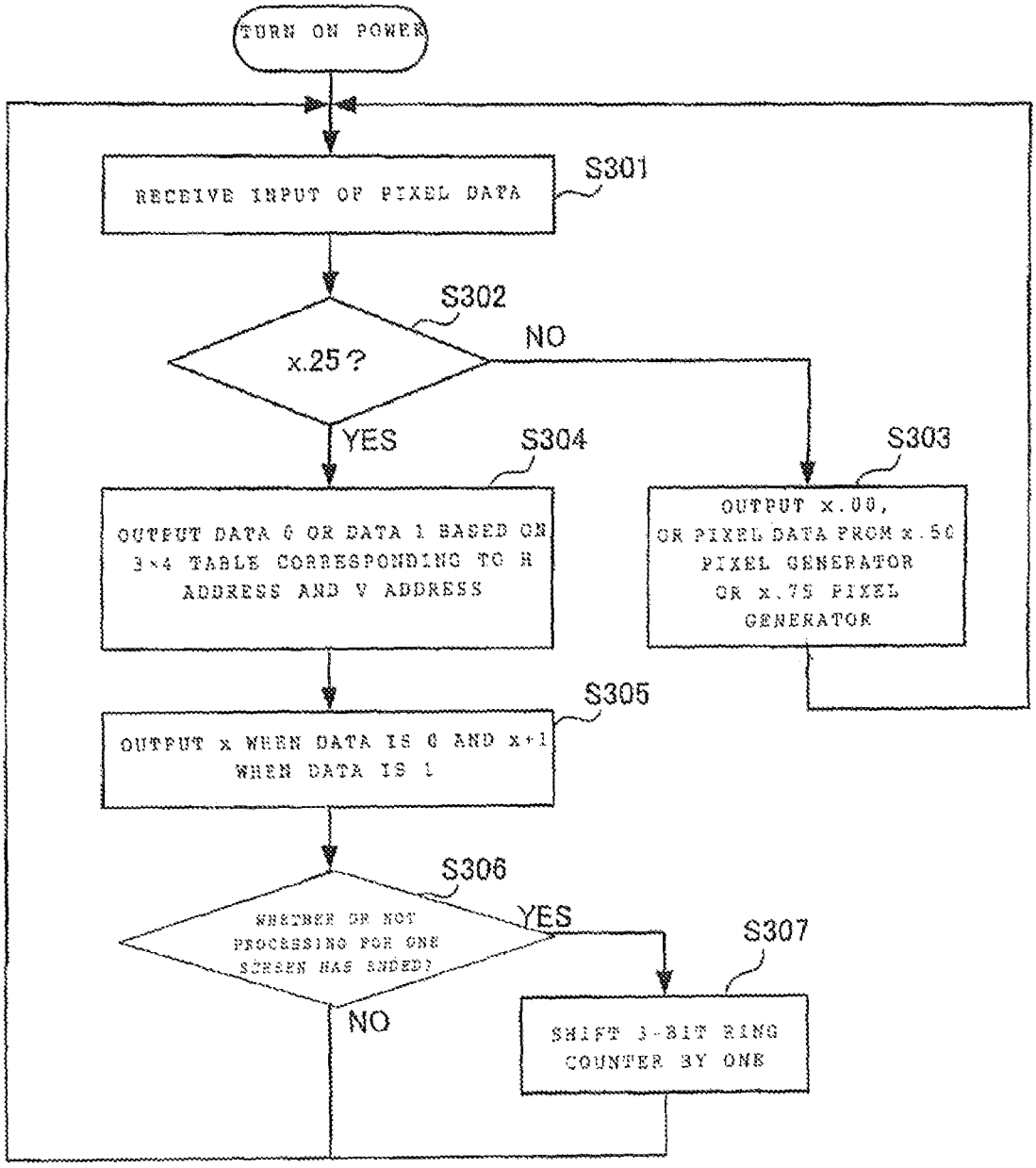
FIG. 24 is a flowchart showing processing of Embodiment 3 hereof.
Figure 25:
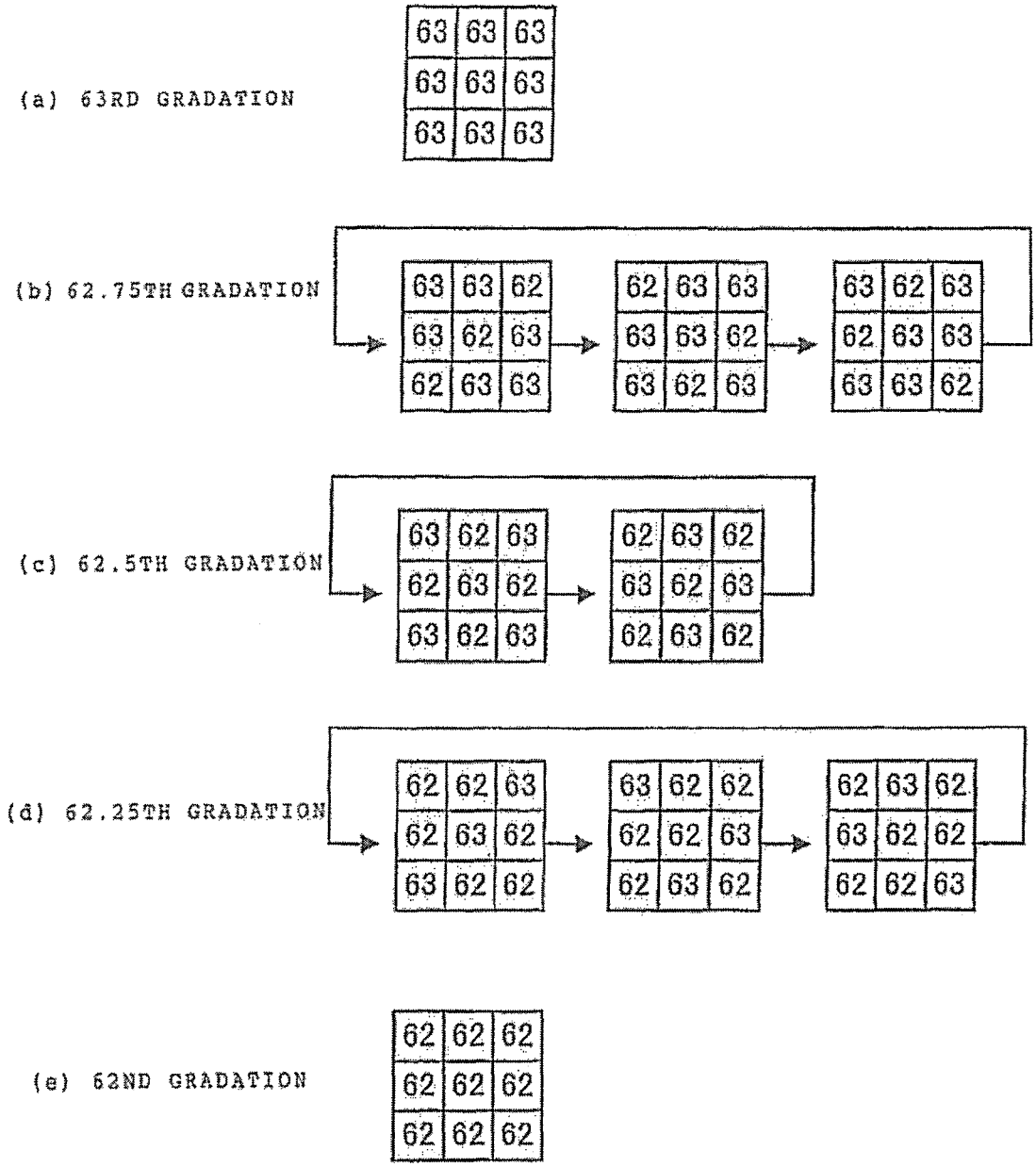
PRIOR ART FIG. 25
FIGS. 25(*a*) to 25(*e*) are diagrams used in explaining the elementary actions of a typical method of FRC.

FIG. 24 is a flowchart showing processing of Embodiment 3, which is executed by the graphics chip 10 shown in FIG. 8. After the power supply is turned on, the graphics chip 10 receives the input of the pixel data through the pixel data input unit 11 (Step 301). Next, it is determined whether or not the inputted pixel data is x.25 (Step 302). When the pixel data is not x.25, the pixel data which is x.00 is directly outputted through the pixel data input unit 11, or the pixel data is outputted through the x.50 pixel generator 20 or the x.75 pixel generator 40 (Step 303), and the processing returns to Step 301. When the pixel data is x.25 in Step 302, data 0 or data 1 is outputted from the selector 35 based on the 3×4 table 34 (Step 304). Then, the x.25 pixel generator 30 outputs x when the data is 0, and outputs x+1 when the data is 1 (Step 305). Here, it is determined whether or not the processing for one screen has ended. In other words, it is determined whether or not the processing for the V lines has been completed (Step 306). When the processing for one screen has not ended yet, the processing directly returns to Step 301, and the same processing is repeated therefrom. When the processing for one screen has ended, the 3-bit ring counter 31 is shifted by one (Step 307). Then, the processing returns to Step 301, and the same processing is repeated therefrom.

As described above, in Embodiment 3, in order to prevent the fixed pattern from flowing in a certain direction, the block of the specific plural lines are shifted rightward, and the block of the next plural lines is shifted leftward. These blocks are selected such that the polarities are neutralized therein in the vertical direction. For example, in the case of the LCD 9 employing the 1H1V inversion drive or the 2H1V inversion drive, the lines are alternately shifted for each block of the 2H lines. Moreover, for example, in the case of the LCD 9 employing the 4H1V inversion drive, the lines are alternately shifted for each block of the 4H lines. Thus, it is made possible to always cancel the polarities which are positive and negative in the vertical lines (V lines), and the standing wave can be restricted from occurring. In Embodiment 3, as long as the shifting cancels the polarities, not only the shifting by every 2H lines but also the alternate shifting for each block of the plural lines such as the 4H lines is performed, thus making it possible to obtain such an effect that the standing wave is restricted.

As described above in detail, according to the disclosed embodiments of the present invention, it is possible to obtain, using a 64 gradation LCD, an image quality at a level favorably comparable with the image quality of a 256 gradation LCD. Moreover, while adopting this improved FRC technology in order to obtain the high image quality, it is still possible to restrict the scale of the driving device, and to avoid any appreciable increase in manufacturing or implementation expense over prior art solutions.

Note that, in these embodiments, with regard to such effects as described above, all of the cases can be theorized by a monochromatic color. Therefore, the above description has been made not by using RGB colors but by using the monochromatic color having the 64 gradations. However, Embodiments 1 and 2 can also be applied to a color LCD, for example, in which three subpixels constitute one pixel as in the case of the monochromatic color. The subpixels are inverted for each color of the R, G and B in the actual LCD drive; however, the FRC is carried out equally for these subpixels of the R, G and B. In a viewpoint of a monochromatic green color, any of the LCD drive and the FRC can be dealt with irrespective of the subpixels of the respective colors. Hence, this embodiment is prescribed by the monochromatic color irrespective of the number of colors (3 colors, 6 colors and so on) and the array of the colors of the R, G and B (horizontal RGB, vertical RGB).

As examples of making full use of the present invention, applications thereof to a driving device for driving the LCD, a graphics chip included in the driving device, and various systems (notebook PC, computer apparatus, and the like) are mentioned.

Although preferred embodiments of the present invention have been described above in detail, it should be understood that various changes, substitutions and alterations can be made thereto without departing from the spirit and scope of the present invention as defined by the appended claims.

What is claimed is:

1. An apparatus for driving a computer system display at a first number of pixel gradations where the display supports a second number of gradations lower than the first number, the apparatus comprising:

pattern generating means for generating a Frame Rate Control (FRC) pattern by allocating, for each pixel, an A-th gradation and a B-th gradation, where A and B are sequential integers equal to or greater than zero and contained within the second number; and shifting means for shifting adjacent lines in different directions reverse to each other, the lines being lines of the FRC pattern generated by the pattern generating means.

2. The apparatus according to claim 1, wherein the shifting means shifts the lines in the different directions reverse to each other by every one line.

3. The apparatus according to claim 1, wherein the shifting means shifts the lines in the different directions reverse to each other by plural lines.

4. The apparatus according to claim 3, wherein the plural lines comprise a combination of lines canceling polarities when polarity inversion drive is performed.

5. The apparatus according to claim 1, wherein the lines shifted in the different directions reverse to each other by the shifting means are any of horizontal lines and vertical lines.

6. The apparatus according to claim 1, wherein the shifting means alternately shifts odd lines and even lines in the different directions reverse to each other when a mixture ratio of the A-th gradation and the B-th gradation is other than 1:1.

7. An apparatus for driving a computer system display at a first number of pixel gradations where the display supports a second number of gradations lower than the first number, the apparatus comprising:

a tile table provided to correspond to a horizontal address and a vertical address of a Frame Rate Control (FRC) pattern formed by allocating, for each pixel, an A-th gradation and a B-th gradation, where A and B are sequential integers equal to or greater than zero and contained within the second number; and a ring counter for shifting lines of the tile table in different directions reverse to each other.

8. The apparatus of claim 7, where the ring counter shifts the lines of the tile table in the different directions reverse to each other by every one line.

9. The apparatus of claim 7, where the ring counter shifts the lines of the tile table in the different directions reverse to each other by every set of lines.

10. The apparatus according to claim 7, wherein the ring counter shifts odd lines and even lines in the different directions reverse to each other by one in response to completing processing of one screen of image.

11. The apparatus according to claim 7, wherein the ring counter shifts the lines in the different directions reverse to each other for each set of lines by one in response to completing processing of one screen of image.

12. A method for driving a computer system display at a first number of pixel gradations where the display supports a second number of gradations lower than the first number, the method comprising:

generating a Frame Rate Control (FRC) pattern by allocating, for each pixel, an A-th gradation and a B-th gradation, where A and B are sequential integers equal to or greater than zero and contained within the second number;

shifting adjacent lines in different directions reverse to each other, the lines being lines of the generated FRC pattern; and outputting pixel data to the display by using a pattern formed by said shifting.

13. The method according to claim 12, wherein the shifting step includes shifting the lines in the different directions reverse to each other by every one line.

14. The method according to claim 12, wherein the shifting step includes shifting the lines in the different directions reverse to each other by plural lines.

15. The method according to claim 14, wherein the plural lines comprise a combination of lines canceling polarities when polarity inversion drive is performed.

16. The method according to claim 12, wherein, in the generated FRC pattern, a mixture ratio of the A-th gradation and the B-th gradation is other than 1:1.

17. The method according to claim 12, wherein the lines shifted in the different directions reverse to each other are any of horizontal lines and vertical lines.

18. The method according to claim 12, wherein the shifting step includes shifting odd lines and even lines in the different directions reverse to each other when a mixture ratio of the A-th gradation and the B-th gradation is other than 1:1.

19. The method according to claim 12, further including using a ring counter to shift the lines in the different directions reverse to each other.

20. The method according to claim 12, further including shifting the lines in the different directions reverse to each other for each set of lines by one in response to completing processing of one screen of image.

* * * * *